US007703902B2

(12) United States Patent
Nozawa et al.

(10) Patent No.: US 7,703,902 B2
(45) Date of Patent: Apr. 27, 2010

(54) LIQUID CARTRIDGE, CONTACT DEVICE FOR CONTACTING CONNECTION TERMINAL PORTION OF LIQUID CARTRIDGE WITH CONNECTOR OF RECORDING APPARATUS, RECORDING APPARATUS, AND LIQUID CONSUMING APPARATUS

(75) Inventors: Izumi Nozawa, Nagano (JP); Satoshi Kobayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 690 days.

(21) Appl. No.: 11/423,219

(22) Filed: Jun. 9, 2006

(65) Prior Publication Data

US 2006/0290754 A1 Dec. 28, 2006

(30) Foreign Application Priority Data

Jun. 9, 2005 (JP) ..... P2005-169016
Dec. 22, 2005 (JP) ..... P2005-370155
Mar. 17, 2006 (JP) ..... P2006-075259

(51) Int. Cl.
*B41J 2/175* (2006.01)

(52) U.S. Cl. ..... 347/86

(58) Field of Classification Search ..... 347/49, 347/85, 86

See application file for complete search history.

(56) References Cited

U.S. PATENT DOCUMENTS 5,157,421 A * 10/1992 Kitahara ..... 347/86
5,506,611 A 4/1996 Ujita et al.
5,896,152 A * 4/1999 Ohashi ..... 347/86
6,074,042 A 6/2000 Gasvoda et al.
6,416,152 B1 * 7/2002 Matsuzaki et al. ..... 347/19

FOREIGN PATENT DOCUMENTS

EP 1 498 272 A1 1/2005
EP 1 504 908 A2 2/2005
JP 2004-001430 1/2004
JP 2005-088575 A 4/2005

OTHER PUBLICATIONS

Extended Search Report from European patent appln. No. 06011964.1-1251 (Oct. 31, 2006).

* cited by examiner

*Primary Examiner*—Anh T. N. Vo
(74) *Attorney, Agent, or Firm*—Stroock & Stroock & Lavan LLP

(57) ABSTRACT

A holder 204 which holds a connector 203 contacting with an electrical connection terminal portion 202 and can move with respect to a recording apparatus is provided, and a relative positioning unit 210 which allows the ink cartridge 11 to contact with the holder 204 and move the holder 204 in an mounting direction (Y-axis direction) of the ink cartridge 11 to determine a relative position between the ink cartridge 11 and the holder 204 when the ink cartridge 11 is mounted is provided.

19 Claims, 25 Drawing Sheets

LIQUID CARTRIDGE, CONTACT DEVICE FOR CONTACTING CONNECTION TERMINAL PORTION OF LIQUID CARTRIDGE WITH CONNECTOR OF RECORDING APPARATUS, RECORDING APPARATUS, AND LIQUID CONSUMING APPARATUS

BACKGROUND OF THE INVENTION

1. Technical Field of the Invention

The present invention relates to a liquid cartridge which is detachably mounted to a liquid consuming apparatus and supplies a liquid stored therein to a liquid consuming apparatus, a contact device for contacting an electrical connection terminal portion provided to the liquid cartridge with a connector provided to a recording apparatus to contact with the connection terminal portion, a recording apparatus having the contact device, and a liquid consuming apparatus.

2. Description of the Related Art

The liquid consuming apparatus denotes all the apparatuses which consumes a liquid supplied to a predetermined portion at a starting time thereof. As a representative example thereof, there is a liquid spray apparatus for spraying liquid droplets through a spray head. The liquid spray apparatus denotes a recording apparatus such as an inkjet recording apparatus, a copier, and a facsimile for performing a recording operation on a recording object such as recording paper by spraying ink on the recording object through a liquid spray head such as a recording head. But not limited to the recording apparatus, the liquid spray apparatus may denote an apparatus for fixing a liquid corresponding to a specific usage instead of the ink on a spray object corresponding to the recording object by spraying the liquid on the spray object through a liquid spray head corresponding to the aforementioned recording head.

As a liquid spray head, there are the aforementioned recording head, a colorant spray head used for producing a color filter of a liquid crystal display or the like, an electrode material (conductive paste) spray head used for producing electrodes of an organic EL display, a surface emitting display (FED), or the like, a bio-organic material spray head used for producing a bio chip, a specimen spray head for spraying a specimen with a precision pipet, and or the like.

An example of the inkjet recording apparatus or the liquid spray apparatus, there is an inkjet printer. The inkjet printer records characters or images by feeding the recording object such as a paper set on a feeding tray one-by-one by using a feeding mechanism, conveying the recording object intermittently by a small length thereof in a sub scan direction by using paper conveying means, and spraying ink droplets on the recording object by using a recording head mounted on a carriage which reciprocally moves in a main scan direction.

Here, there are a type of the ink cartridge (liquid cartridge) mounted on the carriage and a type of the ink cartridge not mounted on the carriage. In the type of the ink cartridge mounted, the carriage reciprocally moves in the main scan direction in an ink cartridge mounted state to supply the ink to the inkjet recording head. In the type of the ink cartridge not mounted, the ink cartridge is provided to a body of the inkjet printer in separation from the carriage, and the ink cartridge and the inkjet recording head are connected through an ink supply tube.

In any types, a memory portion for storing a production data, a product serial, and information on ink such as remaining ink amount and a connection terminal portion for connecting the memory portion to an external circuit are provided to the ink cartridge. The cartridge mounting portion of the printer to which the ink cartridge is mounted is provided with a connector which is connected to the connection terminal portion.

A head mounting portion of the carriage of the printer is provided with a circuit substrate which is connected through the connector to the memory portion of the ink cartridge and the recording head. By such a construction, the printer transmits and receives information on the ink to and from the ink cartridge to use the information to detect the remaining ink amount or control operations such as a notification of a replacement time of the ink cartridge.

Hereinafter, an inkjet recording apparatus including an ink carriage having a conventional memory portion and a connector are described.

FIG. 27 shows a recording apparatus having a cartridge mounting portion which an ink carriage 501 can be inserted into or taken out according to a rotation of a lever arm 507.

An example of the memory for storing the aforementioned information is an information storage unit 502 including a first connection terminal portion 503 of which connection terminals are exposed and a memory portion 504 which is electrically connected to the first connection terminal portion 503. The first connection terminal portion 503 contacts with a second connection terminal portion 506 of a connector 505 which is fixed to a recording apparatus so as to be electrically connected thereto. Here, the memory portion 504 stores the information on the ink or the like.

In addition, a position of the ink cartridge 501 is moved in a direction indicated by the arrow according to a rotation of the lever arm 507 to mount the ink cartridge 501, and the first connection terminal portion 503 is allowed to contact with the second connection terminal portion 506 of the recording apparatus.

In general, since the first and second connection terminal portions 503 and 506 are formed in very small sizes, when a variation of a mounting position of the mounted ink cartridge 501 occurs, the first connection terminal portion 503 may not be electrically connected to the second connection terminal portion 506.

Therefore, in a prior art, a convex portion (not shown) for determining a position with respect to the cartridge mounting portion is provided to the ink cartridge 501, so that the variation of the mounting position of the mounted ink cartridge 501 can be reduced (for example, see Japanese Unexamined Patent Application Publication No. 2004-001430).

In other words, the second connection terminal portion 506 is fixed to the carriage, and the ink cartridge 501 intends to be accurately positioned with respect to a carriage having the fixed second connection terminal portion 506 or a recording apparatus body.

However, since the aforementioned techniques are not sufficient, it is difficult to remove the variation of the position of the mounted ink cartridge 501. In particular, as shown in the figure, in the conventional ink cartridge, the first connection terminal portion 503 is disposed to a relatively large flat wall surface (upper wall surface in the figure) 508. In addition, for the purpose of implanting a small-sized light-weighted one, a plate thickness of the wall portion of the cartridge is reduced. However, a sufficient rigidity cannot be obtained by using a large wall surface 508, and molding deformation such a wave-like pattern may easily occur. Due to the influence of the molding deformation and insufficient rigidity, it is very difficult to remove the positioning accuracy of the ink cartridge 501 with respect to the connector which is fixed at an accurate position.

For the reason, the first connection terminal portion 503 may not be electrically connected to the second connection terminal portion 506 of the connector 505.

SUMMARY OF THE INVENTION

Therefore, in order to solve the aforementioned problem, an object of the present invention is to provide a liquid cartridge capable of allowing a connection terminal portion to be electrically connected to a connector (second connection terminal) of a recording apparatus at an improved positioning accuracy at a time of mounting the liquid cartridge to a cartridge mounting portion and a contact device therefore.

In order to solve the aforementioned problems, according to a first aspect of the present invention, there is provided a liquid cartridge comprising: a container body, adapted to detachably mount to a cartridge mounting portion of a liquid consuming apparatus; a connection terminal portion, provided to a side surface of the container body and adapted to contact with an electrical connector provided to a side of the cartridge mounting portion; and an inserting direction contact surface, provided to at least one of both side portions of an inserting direction front end side of the container body and contactable with the cartridge mounting portion, wherein the connection terminal portion is provided in the vicinity of the inserting direction contact surface.

According to the liquid cartridge of the first aspect of the present invention, the side portion (a front end portion of the side wall) of the inserting direction front end side provided with the inserting direction contact surface is disposed to be close to the corner portion having a high rigidity even in a case where the wall portion of the container body is formed to be thin in comparison with, for example, a central portion of the front surface constituting the inserting direction front end side or a central portion of a large-sized wall surface. Therefore, it is possible to obtain a high rigidity without bending or the like. In addition, in a case where the container body is formed by performing an injection molding process on a resin, it becomes a portion where deformation is not easy to occur, so that it is possible to obtain a high molding accuracy.

Namely, since the inserting direction contact surface can be formed to have a high rigidity with a high accuracy, it is possible to determine the position of the liquid cartridge with a high accuracy when the liquid cartridge is mounted on the cartridge mounting portion.

In addition, since the connection terminal portion is provided in the vicinity of the inserting direction contact surface of which position is determined with a high accuracy, the positioning accuracy of the connection terminal portion to the cartridge mounting portion can be improved. As a result, it is possible to securely connect the connection terminal portion provided to the liquid cartridge to the connector provided to the cartridge mounting portion.

According to a second aspect of the present invention, in the liquid cartridge according to the first aspect, the inserting direction contact surface contacts with a holder holding the connector and movable with respect to the cartridge mounting portion, and moves the holder in a mounting direction of the liquid cartridge.

According to the liquid cartridge of the second aspect of the present invention, when the liquid cartridge is inserted into the cartridge mounting portion, the connector moves according to the inserting of the cartridge. Therefore, the position accuracy between the inserting direction contact surface and the connector can be maintained to be a high accuracy irrespective of whether or not there is a variation in size of the container body in the inserting direction. As a result, it is possible to improve reliability of electrical connection between the connection terminal portion of the liquid cartridge and the connector of the cartridge mounting portion.

According to a third aspect of the present invention, in the liquid cartridge according to the first or second aspect, a positioning hole which determines a position the container body with respect to the cartridge mounting portion is disposed to the inserting direction front end side of the container body provided with the inserting direction contact surface, and the connection terminal portion is disposed to another side surface perpendicular to the inserting direction front end side of the container body.

According to the liquid cartridge of the third aspect of the present invention, the spring force of the pin-shaped terminal of the connector which is pressed to contact with the connection terminal portion becomes a force of pressing the container body along the inserting direction front end surface provided with the positioning holes and a pressing force for removing a gutter between the positioning holes and the positioning pin of the cartridge mounting portion engaged with the positioning holes. As a result, a variation in contactness between the connection terminal portion and the connector caused from the occurrence of the gutter does not occur, so that it is possible to further stabilize a performance of electrical connection between the connection terminal portion and the connector.

According to a fourth aspect of the present invention, in the liquid cartridge according to the third aspect, the inserting direction contact surface is set to a position near the positioning hole.

According to the liquid cartridge of the fourth aspect of the present invention, the positioning accuracy of the inserting direction contact surface with respect to the cartridge mounting portion can be improved. As a result, it is possible to further stabilize a performance of electrical connection between the connection terminal portion and the connector.

According to a fifth aspect of the present invention, in the liquid cartridge according to any one of the first to fourth aspects, a waste liquid recovery opening for recovering a waste liquid in the container body is provided to a side portion opposite to the side portion of the inserting direction front end side near the side surface provided with the connection terminal portion.

According to the liquid cartridge of the fifth aspect of the present invention, a separation distance between the waste liquid recovery opening and the connection terminal portion is increased. As a result, although the waste solution is leaked out in the vicinity of the waste liquid recovery opening at a time of replacing the cartridge or the like, it is possible to prevent a problem in that the leaked waste solution is attached on the connection terminal portion.

According to a sixth aspect of the present invention, in the liquid cartridge according to the fifth aspect, the waste liquid recovery opening is set to a position near the positioning hole.

According to the liquid cartridge of the sixth aspect of the present invention, the positioning accuracy of the waste liquid recovery opening with respect to the cartridge mounting portion can be improved. Therefore, an accuracy of connection between a waste supply pipe provided to the cartridge mounting portion and the waste liquid recovery opening can be improved. As a result, it is possible to prevent a problem of the leakage of the waste solution caused from deterioration of the accuracy of connection.

According to a seventh aspect of the present invention, in the liquid cartridge according to any one of the first to sixth aspects, a plurality of liquid storage packs which stores a liquid supplied to the liquid consuming apparatus are accommodated in the container body, and a plurality of liquid supply openings which connect the packs to the liquid consuming apparatus are provided to a surface of the inserting direction front end side of the container body.

According to the liquid cartridge of the seventh aspect of the present invention, many kinds of liquids supplied to a liquid consuming apparatus can be accommodated in a single container body in comparison with a case where liquid cartridges dedicated to kinds of liquids are individually prepared, simplification of the positioning mechanism provided to the cartridge mounting portion or the reduction of the number of parts thereof can be implemented. As a result, it is possible to obtain a compact product and reduce production cost.

According to an eighth aspect of the present invention, in the liquid cartridge according to the seventh aspect, a plurality of the liquid supply openings are arrayed between two positioning holes provided to the surface of the inserting direction front end side of the container body.

According to the liquid cartridge of the eighth aspect of the present invention, when the liquid cartridge is mounted on the cartridge mounting portion, a variation of the positions of the liquid supply openings can be suppressed below a variation width between the two positioning holes. As a result, it is possible to improve a performance of connection between the liquid supply needles or the like provided to the cartridge mounting portion and the liquid supply openings.

According to a ninth aspect of the present invention, in the liquid cartridge according to the eighth aspect, the waste liquid recovery opening is provided to outer sides of the two positioning holes provided to the surface of the inserting direction front end side of the container body.

According to the liquid cartridge of the ninth aspect of the present invention, the positioning hole is interposed between the liquid supply opening and the waste liquid recovery opening. Therefore, although the waste solution is leaked out in the vicinity of the waste liquid recovery opening at a time of replacing the cartridge or the like, the positioning hole can suppress the leaked waste solution from flowing along the wall surface of the container toward the liquid supply opening. As a result, it is possible to prevent a problem in that the leaked waste solution is attached on liquid supply opening.

According to a tenth aspect of the present invention, there is provided a contact device, adapted to contact an electrical connection terminal portion provided to a liquid cartridge with a connector provided to a recording apparatus, the contact device comprising: a holder, holding the connector and movable with respect to the recording apparatus; and a relative positioning unit, operable to contact the liquid cartridge with the holder and moves the holder in a mounting direction of the liquid cartridge so as to determine a relative position between the liquid cartridge and the holder when the liquid cartridge is mounted.

According to the contact device of the tenth aspect of the present invention, the contact device for contacting the connection terminal portion of the liquid cartridge with the connector of the recording apparatus includes the relative positioning unit. Therefore, when the liquid cartridge is mounted, the liquid cartridge contacts with the holder and moves the holder in the mounting direction of the liquid cartridge, so that it is possible to determine the relative position between the liquid cartridge and the holder.

As a result, it is possible to surely contact the connection terminal portion of the liquid cartridge with the connector of the recording apparatus body. Namely, it is possible to electrically connect the connection terminal portion to the connector. In addition, the recording apparatus body can read the information on the remaining liquid amount from the storage device of the liquid cartridge or write the information on the remaining liquid amount to the storage device.

According to an eleventh aspect of the present invention, in the contact device for contacting the connection terminal portion of the liquid cartridge with the connector of the recording apparatus according to the tenth aspect, the relative positioning unit comprises: a contact portion which contacts with a mounting direction front side of the liquid cartridge in the holder; and a biasing member for pressing the contact portion against a movement of the liquid cartridge at a time of mounting the liquid cartridge.

According to the contact device of the eleventh aspect of the present invention, in addition to the operations and effects as those of the tenth aspect, the relative positioning unit comprises: a contact portion which contacts with a mounting direction front side of the liquid cartridge in the holder; and a biasing member for pressing the contact portion against a movement of the liquid cartridge at a time of mounting the liquid cartridge.

Accordingly, it is possible to determine a relative positional relation between the liquid cartridge and the holder with a simple construction and a high accuracy in the mounting direction of the liquid cartridge.

According to a twelfth aspect of the present invention, in the contact device for contacting the connection terminal portion of the liquid cartridge with the connector of the recording apparatus according to the eleventh aspect, a restriction portion which restricts a movement of the holder in a direction perpendicular to the mounting direction of the liquid cartridge at a time of the holder moving is provided to the recording apparatus, and the biasing member presses the holder toward the restriction portion.

According to the contact device of the twelfth aspect of the present invention, in addition to the operations and effects as those of the eleventh aspect, the biasing member also presses the holder toward the restriction portion. Namely, due to the pressing means and the restriction portion, it is possible to restrict the movement direction of the holder in only the mounting direction of the liquid cartridge.

Therefore, it is possible to determine the position of the holder in the direction perpendicular to the mounting direction of the liquid cartridge in any time. As a result, it is possible to contact the connector of the recording apparatus with the connection terminal portion of the liquid cartridge with a high accuracy.

In addition, since the pressing force of the pressing means is used, there is no need to provide additional pressing means.

According to a thirteenth aspect of the present invention, in the contact device for contacting the connection terminal portion of the liquid cartridge with the connector of the recording apparatus according to the eleventh or twelfth aspect, a restriction portion which restricts a movement of the holder in a direction perpendicular to the mounting direction of the liquid cartridge at a time of the holder moving is provided to the recording apparatus, and the restriction portion directly contacts with the connector to restrict a position in a facing direction of the connector and the connection terminal portion.

According to the contact device of the thirteenth aspect of the present invention, in addition to the operations and effects as those of the eleventh or twelfth aspect, the restriction portion directly contacts with the connector to restrict a position in a facing direction of the connector and the connection terminal portion. Namely, the restriction portion directly contacts with the connector without the holder.

Therefore, a tolerance of the holder does not influence, so that it is possible to improve a positioning accuracy in the facing direction of the connection terminal portion as a direction perpendicular to the mounting direction of the liquid cartridge.

According to a fourteenth aspect of the present invention, in the contact device for contacting the connection terminal portion of the liquid cartridge with the connector of the recording apparatus according to any one of the eleventh to thirteenth aspects, the connection terminal portion is constructed to contact with the connector on a surface parallel to a mounting direction of the liquid cartridge, wherein a connector restriction portion for restricting a movement of the connector with respect to the holder is provided to a front side of the holder in the mounting direction of the liquid cartridge, and a claw member for having a pressing force toward the connector restriction portion is provided to a rear side thereof, and wherein the connector is interposed by the connector restriction portion and the claw member.

When the liquid cartridge is mounted, it is possible to determine the relative position between the liquid cartridge and the holder in the mounting direction with a high accuracy. However, a friction is generated due to contact between the liquid cartridge and the connector. At this time, if the friction is exerted in a state where there is a gutter caused from the tolerance between the holder and the connector, the position of the connector at the time of mounting may be deviated toward the mounting direction front end side with respect to the holder and the liquid cartridge.

According to the contact device of the fourteenth aspect of the present invention, in addition to the operations and effects as those of any one of the eleventh to thirteenth aspects, the connector is interposed by the connector restriction portion and the claw member having a pressing force toward the connector restriction portion.

Therefore, the gutter between the holder and the connector portion is removed, so that the position of the connector portion cannot be deviated from the holder and the liquid cartridge in the mounting direction.

In addition, according to the aspect, the holder includes the connector restriction portion to the front end side thereof in the mounting direction of the liquid cartridge and the claw member to the rear end side thereof. Namely, when the liquid cartridge is mounted, the connector restriction portion is provided to the front end side where the frictional force is exerted to the holder, and the claw member is provided to the rear end side where the frictional force is not exerted to the holder.

Therefore, when the liquid cartridge is mounted, although the frictional force occurs, the connector can be restricted by the connector restriction portion. The claw member in cooperation with the connector restriction portion interposes the connector and stably determines the position without deformation and with the pressing force maintained. As a result, when the liquid cartridge is mounted, the position of the connector in the mounting direction cannot be deviated with respect to the holder and the liquid cartridge.

According to a fifteenth aspect of the present invention, in the contact device for contacting the connection terminal portion of the liquid cartridge with the connector of the recording apparatus according to any one of the eleventh, thirteenth, and fourteenth aspects, engagement means are provided to a position where the contact portion contacts with the liquid cartridge, and a cone-shaped convex portion is provided to one of the engagement means to be pointed toward the other thereof, and a concave portion which is engaged with the convex portion is provided to the other thereof.

According to the fifteenth aspect of the present invention, in addition to the operations and effects as those of any one of the eleventh, thirteenth, and fourteenth aspects, engagement means are provided to a position where the contact portion contacts with the liquid cartridge, and a cone-shaped convex portion is provided to one of the engagement means to be pointed toward the other thereof, and a concave portion which is engaged with the convex portion is provided to the other thereof. At this time, since the convex portion is formed to have a shape of a cone, the convex portion has a slanted portion.

As a result, the convex portion is guided by the slanted portion to be engaged with the concave portion. Namely, it is possible to restrict the relative positional relation between the liquid cartridge and the holder in the slanted direction of the slanted portion. For example, in a case where the slanted portion is arranged to be slanted toward the height direction of the liquid cartridge, it is possible to restrict the relative positional relation between the liquid cartridge and the holder in the height direction thereof.

According to a sixteenth aspect of the present invention, in the contact device for contacting the connection terminal portion of the liquid cartridge with the connector of the recording apparatus according to the fifteenth aspect, the cone-shaped convex portion of the engagement means has a first slanted portion, and the first slanted portion is formed to be similar to a slated surface of a circular cone.

According to the sixteenth aspect of the present invention, in addition to the operations and effects as those of the fifteenth aspect, the cone-shaped convex portion of the engagement means has a first slanted portion, and the first slanted portion is formed to be similar to a slated surface of a circular cone. Namely, the first slanted portion is formed in all the directions perpendicular to the mounting direction of the liquid cartridge.

Accordingly, it is possible to determine a relative positional relation between the liquid cartridge and the holder in a direction perpendicular to the mounting direction of the liquid cartridge.

According to a seventeenth aspect of the present invention, in the contact device for contacting the connection terminal portion of the liquid cartridge with the connector of the recording apparatus according to the fifteenth aspect, the cone-shaped convex portion of the engagement means has a second slanted portion, and the second slanted portion is formed to be similar to a slated surface of a polygonal pyramid.

According to the seventeenth aspect of the present invention, in addition to the operations and effects as those of the fifteenth aspect, the second convex portion which is the cone-shaped convex portion of the engagement means is provided with the second slanted portion, and the second slanted portion is formed to be similar to a slanted surface of a polygonal pyramid. Namely, when the second convex portion is engaged with the concave portion, the second convex portion is guided toward a vertex of the polygonal pyramid with respect to the concave portion by the second slanted portion formed to be similar to the slanted surface of the polygonal pyramid in a direction perpendicular to the mounting direction of the liquid cartridge.

Accordingly, it is possible to determine a relative positional relation between the liquid cartridge and the holder in a direction perpendicular to the mounting direction of the liquid cartridge.

In addition, since the second slanted portion is formed to be similar to the surface of the polygonal pyramid, the second slanted portion cannot be engaged with the concave portion in a distorted state thereof around the mounting direction of the liquid cartridge as a shaft. Namely, the liquid cartridge and the holder cannot contact with each other in a distorted state around the mounting direction of the liquid cartridge as a shaft. Accordingly, the second slanted portion allows the substrate of the liquid cartridge and the connector of the recording apparatus body to face each other in parallel so as to securely contact with each other.

According to an eighteenth aspect of the present invention, in the contact device for contacting the connection terminal portion of the liquid cartridge with the connector of the recording apparatus according to any one of the fifteenth to seventeenth aspects, the connector has pin-shaped terminals which are connected to the connection terminal portion, and the pin-shaped terminals are formed to be pin springs for pressing the connection terminal portion at a position of the connection terminal portion facing the connector.

According to the eighteenth aspect of the present invention, in addition to the operations and effects as those of any one of the fifteenth to seventeenth aspects, the connector includes the pin-shaped terminals for pressing the connection terminal portion.

Therefore, when the connection terminal portion is located to a position facing the connector, the pin-shaped terminals can securely contact with the connection terminal portion.

According to a nineteenth aspect of the present invention, in the contact device for contacting the connection terminal portion of the liquid cartridge with the connector of the recording apparatus according to the eighteenth aspect, a plurality of the pin-shaped terminals are provided, and the number of the connection terminal portions provided on a substrate and contactable with the pin-shaped terminals are equal to the number of the pin-shaped terminals, and wherein the substrate is disposed on a surface parallel to the mounting direction of the liquid cartridge to face the connector at a time of mounting the liquid cartridge.

In a case where a plurality of the pin-shaped terminals are provided, a total pressing force of the pin-shaped terminals is obtained by multiplying the number of the pin-shaped terminals. In addition, when the liquid cartridge is mounted, the pressing force of the pin-shaped terminal may be exerted against the movement of the liquid cartridge. In addition, after the liquid cartridge is mounted, the liquid cartridge may be pressed toward a direction where the liquid cartridge is detached, so that the mounting thereof may be incompletely performed. In other words, the liquid supply needle may not completely be inserted into the liquid cartridge.

According to the nineteenth aspect of the present invention, in addition to the operations and effects as those of the eighteenth aspect, the substrate is disposed on a surface parallel to the mounting direction of the liquid cartridge to face the connector at a time of mounting the liquid cartridge. Namely, the mounting direction of the liquid cartridge and the direction perpendicular to the substrate, that is, the pressing direction of the pin-shaped terminal have a perpendicular relation.

As a result, when the liquid cartridge is mounted, the pressing force of the pin-shaped terminal cannot be exerted against the movement of the liquid cartridge. In addition, after the liquid cartridge is mounted, the liquid cartridge cannot be pressed toward the direction where the liquid cartridge is detached, so that the mounting thereof cannot be incompletely performed.

According to a twentieth aspect of the present invention, in the contact device for contacting the connection terminal portion of the liquid cartridge with the connector of the recording apparatus according to the nineteenth aspect, the convex portion is a protrusion which is formed to extend in a direction perpendicular to the substrate.

According to the twentieth aspect of the present invention, in addition to the operations and effects as those of the nineteenth aspect, the convex portion is a protrusion which is formed to extend in a direction perpendicular to the substrate. For example, in a case where the convex portion is formed to extend in the direction, it is possible to restrict the positional relation between the liquid cartridge and the holder in a direction perpendicular to the direction and to reduce distortion caused from a tolerance of components. Namely, the convex portion allows the substrate to face the connector in parallel.

As a result, it is possible to securely contact a plurality of the pin-shaped terminals with the connection terminal portions having the number equal to the number of the pin-shaped terminals individually.

According to a twenty first aspect of the present invention, there is provided a recording apparatus having a contact device for contacting an electrical connection terminal portion provided to a liquid cartridge with a connector provided to a recording apparatus to contact with the connection terminal portion, wherein the contact device is the contact device according to any one of the tenth to twentieth aspects.

According to the twenty first aspect of the present invention, since the recording apparatus includes the contact device according to any one of the tenth to twentieth aspects, it is possible to obtain the operations and effects as those of any one of the tenth to twentieth aspects.

According to a twenty second aspect of the present invention, there is provided a liquid consuming apparatus, comprising: a connector, contactable with an electrical connection terminal provided to a liquid cartridge; a holder, holding the connector and movable with respect to the recording apparatus; and a relative positioning unit, operable to contact the liquid cartridge with the holder and move the holder in a mounting direction of the liquid cartridge so as to determine a relative position between the liquid cartridge and the holder when the liquid cartridge is mounted to the liquid consuming apparatus.

According to the liquid consuming apparatus of the twenty second aspect of the present invention, the liquid consuming apparatus includes the relative positioning unit. Therefore, when the liquid cartridge is mounted, the liquid cartridge contacts with the holder and moves the holder in the mounting direction of the liquid cartridge, so that it is possible to determine the relative position between the liquid cartridge and the holder.

Therefore, it is possible to surely contact the connection terminal portion of the liquid cartridge with the connector of the recording apparatus body. Namely, it is possible to electrically connect the connection terminal portion to the connector.

According to the liquid cartridge of the present invention, the side portion of the inserting direction front end side provided with the inserting direction contact surface is disposed to be close to the corner portion having a high rigidity, so that it is possible to obtain a high rigidity without bending or the like. In addition, in a case where the container body is formed by performing an injection molding process on a resin, it becomes a portion where deformation is not easy to occur, so that it is possible to obtain a high molding accuracy.

Namely, since the inserting direction contact surface can be formed to have a high rigidity with a high accuracy, it is possible to determine the position of the liquid cartridge with a high accuracy when the liquid cartridge is mounted on the cartridge mounting portion. In addition, since the connection terminal portion is provided in the vicinity of the inserting direction contact surface of which position is determined with a high accuracy, the positioning accuracy of the connection terminal portion to the cartridge mounting portion can be improved. As a result, it is possible to securely connect the connection terminal portion provided to the liquid cartridge to the connector provided to the cartridge mounting portion.

In addition, according to the contact device for contacting the connection terminal portion of the liquid cartridge with the connector of the recording apparatus, the recording apparatus, and the liquid consuming apparatus, the contact device for contacting the connection terminal portion of the liquid cartridge with the connector of the recording apparatus includes the relative positioning unit.

Therefore, when the liquid cartridge is mounted, the liquid cartridge contacts with the holder and moves the holder in the mounting direction of the liquid cartridge, so that it is possible to determine the relative position between the liquid cartridge and the holder.

Namely, it is possible to surely contact the connection terminal portion of the liquid cartridge with the connector of the recording apparatus body. As a result, it is possible to electrically connect the connection terminal portion to the connector.

DETAILED DESCRIPTION OF THE INVENTION

Hereinafter, an attaching/detaching device of a liquid cartridge according to the present invention and a recording apparatus as an example of a liquid consuming apparatus having the attaching/detaching device are be described. Firstly, an inkjet printer is employed as the best mode of carrying out the recording apparatus, and a whole construction thereof is described in brief with reference to the accompanying drawings.

Figure 1:
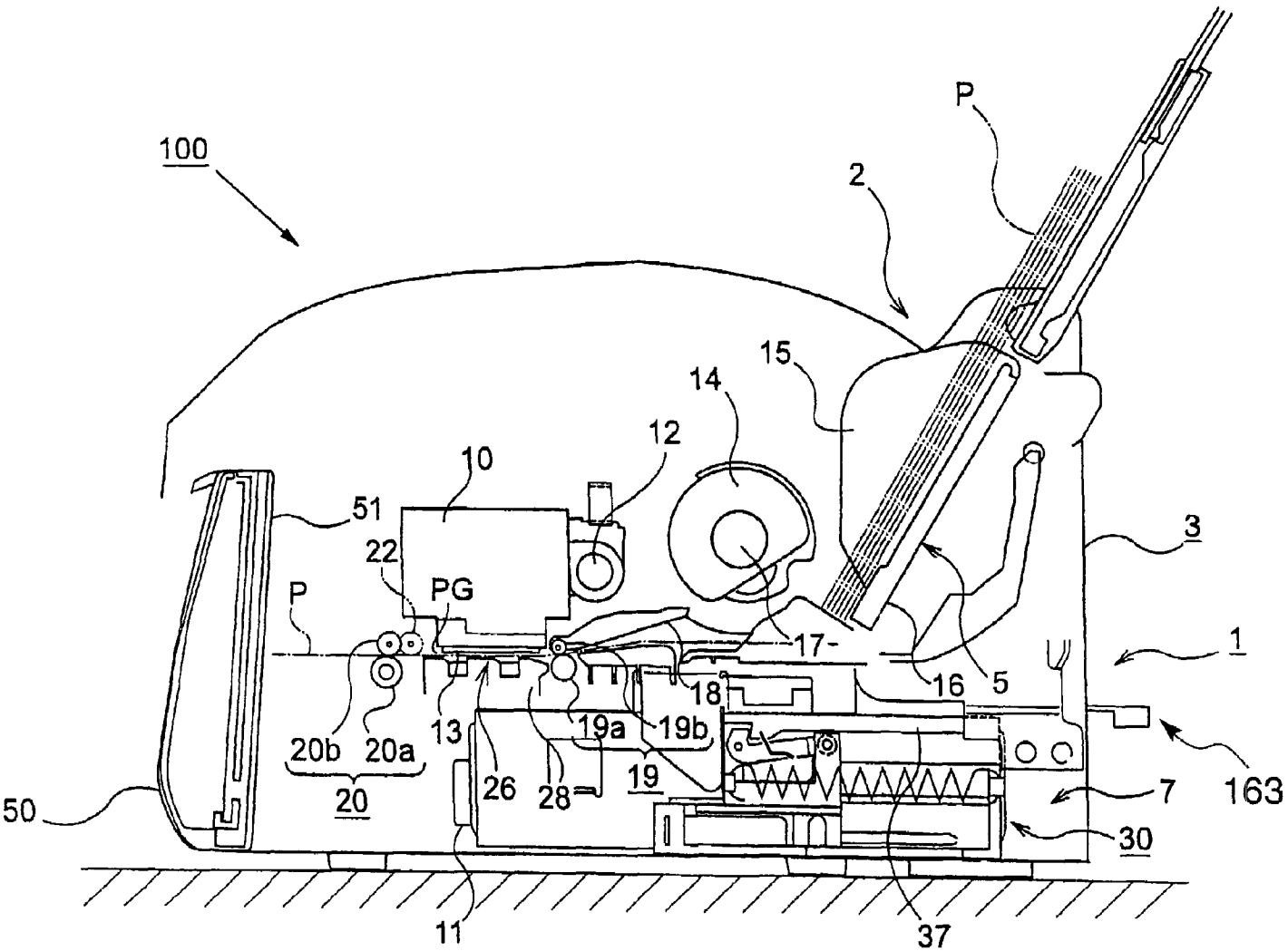
FIG. 1 is a schematic cross sectional side view showing an inkjet printer as a liquid consuming apparatus where a liquid cartridge according to an embodiment of the present invention is mounted.

FIG. 1 is a schematic cross sectional side view showing an inkjet printer as a liquid consuming apparatus where a liquid cartridge according to an embodiment of the present invention is mounted.

The inkjet printer (liquid consuming apparatus) 100 shown in FIG. 1 is provided with a carriage 10 as a main component of recording performing means (as an example of liquid spray performing means) for performing a recording operation on a recording object P (as an example of a liquid spray object; hereinafter, simply referred to as a paper P). The carriage is shaft-supported around a carriage guide shaft 12 so as to reciprocally move in a main scan direction (a direction perpendicular to a paper surface in FIG. 1).

A recording head 13 (as an example of a liquid spray head) for performing the recording operation by ejecting (spraying) ink (as an example of a liquid) on the paper P is mounted on the carriage 10. Under the carriage 10, a cartridge mounting portion 7 where a single package ink cartridge 11 (as an example of a liquid cartridge) is mounted through the later-described attaching/detaching device 1 is provided to a lower space of the recording apparatus body 3.

A platen 28 which faces the recording head 13 which faces the recording head 13 to define a gap PG between a head surface of the recording head 13 and the paper P is provided under the recording head 13. The recording operation is performed on the paper P by alternately repeating an operation of conveying the paper P between the carriage 10 and the platen 28 in a sub scan direction (leftward and rightward directions in FIG. 1) perpendicular to the main scan direction by a predetermined conveying amount thereof and an operation of spraying the ink on the paper P from the recording head 13 during the time interval of reciprocating the recording head 13 at one time in the main scan direction.

Next, a construction of the inkjet printer 100 is described more in detail along a conveying path of the paper P.

Firstly, a feeding tray 5 (as an example of a liquid spray object stacking unit) where the paper P is stacked is provided to an uppermost conveying direction upstream. In addition, an edge guide 15 which contacts with a side end surface of the paper P to guide smooth conveying in the sub scan direction is provided to the feeding tray 5.

A hopper 16 is lifted up at a predetermined timing according to a rotation of a rotation shaft 17 of the feeding roller 14, so that the paper P on the feeding tray 5 is pushed up toward the feeding roller 14.

A unit including the feeding tray 5, the feeding roller 14, and the hopper 16 is an automatic feeding unit 2.

According to the rotation of the feeding roller 14, the papers P in units of predetermined number are sequentially picked up in an order of from the paper stacked on the uppermost surface and conveyed to a convey direction downstream by a force of a separation pad (as an example of a separation operation portion) provided near the feeding roller 14.

Recording object detecting means (as an example of liquid spray object detecting means; hereinafter, simply referred to as a detection lever) (not shown) for detecting passing of the paper P is provided to a downstream of the feeding roller 14.

A conveying roller 19 constructed with a convey driving roller 19*a* and a convey driven roller 19*b* is provided to a downstream of the detection lever. The convey driven roller 19*b* is shaft-supported at a downstream of the roller holder 18 for the convey driven roller. The roller holder 18 is arranged to rotate around a rotation shaft (not shown), and the convey driven roller 19*b* is rotated and pressed by a torsion spring (not shown) so as to be in a nip state where the convey driven roller is always pressed to contact with the convey driving roller 19*a*.

The paper P which is conveyed in a state where the paper is pressed by the conveying roller 19 is guided to a recording position 26 under the recording head 13, and a desired recording operation is performed on the almost entire surface of the recording surface of the paper P by operations of the aforementioned carriage 10 and the paper P.

The gap PG between the recording head 3 and the platen 28 which is provided under the recording head to face the recording head is a very important factor for performing the recording operation with a high accuracy. Therefore, the gap is adjusted suitably according to a change in thickness of the paper P.

A discharging roller 20 (as an example of liquid spray object discharging means) constructed with a discharge driving roller 20*a* and a discharge driven roller 20*b* is provided to a downstream of the recording head 13. The paper P discharged by the discharging roller 20 is discharged on a stacking surface 51 of the discharging stacker 50 (as an example of a liquid spray object receiving portion) disposed at a downstream.

The discharge driven roller 20*b* is a teeth-attached roller having a plurality of teeth around circumference thereof and rotatably shaft-supported by a roller holder (not shown) for the discharge driven roller. An auxiliary driven roller 22 is provided at an upstream of the discharge driven roller 20*b*, and the paper P is pressed downwardly by the auxiliary driven roller 22. In addition, a shaft center of the convey driven roller 19*b* is disposed to be slightly at a downstream of the convey driving roller 19*a*. In addition, a shaft center of the discharge driven roller 20*b* is disposed to be slightly at an upstream of the discharge driving roller 20*a*.

By such a construction, the paper P becomes a curved state where the paper is convex downwardly between the conveying roller 19 and the discharging roller 20, which is called "reverse bending". The paper located at a position facing the recording head 13 is pressed by the platen 28, so that floating of the paper P is prevented. As a result, the recording operation is performed normally. Similar to the discharge driven roller 20*b*, the auxiliary driven roller 22 is constructed with a teeth-attached roller and shaft-supported by a roller holder (not shown) of the auxiliary driven roller.

The inkjet printer 100 according to the embodiment is a type of printer which uses a single package type ink cartridge 11 constructed by integrating ink cartridges in a plurality of colors and allows the ink cartridge 11 to slide from a lower portion of the feeding tray 5 (at a rear side of the recording apparatus body 3) in a horizontal direction so as to mount the ink cartridge.

In the figure, reference numeral 30 denotes cartridge holding means of the cartridge mounting portion 7. When the ink cartridge 11 is inserted by a first predetermined stroke, the cartridge holding means 30 allows a slide lock piece 48 to be engaged with an engagement concave portion 57 of the ink cartridge so as to hold the ink cartridge.

In addition, in the cartridge mounting portion 7 according to the embodiment, a rotation of a later-described lever arm 163 constituting the attaching/detaching device 1 of the ink cartridge is transmitted through a power transmission conversion mechanism 32 (see FIG. 2) so as to insert a pair of left and right cartridge holding means 30 and 30 in a state of holding the ink cartridge 11 by a second predetermined stroke S.

In the specification, the operation of inserting the ink cartridge 11 by the second predetermined stroke S is defined as "mounting of the ink cartridge".

Figure 2:
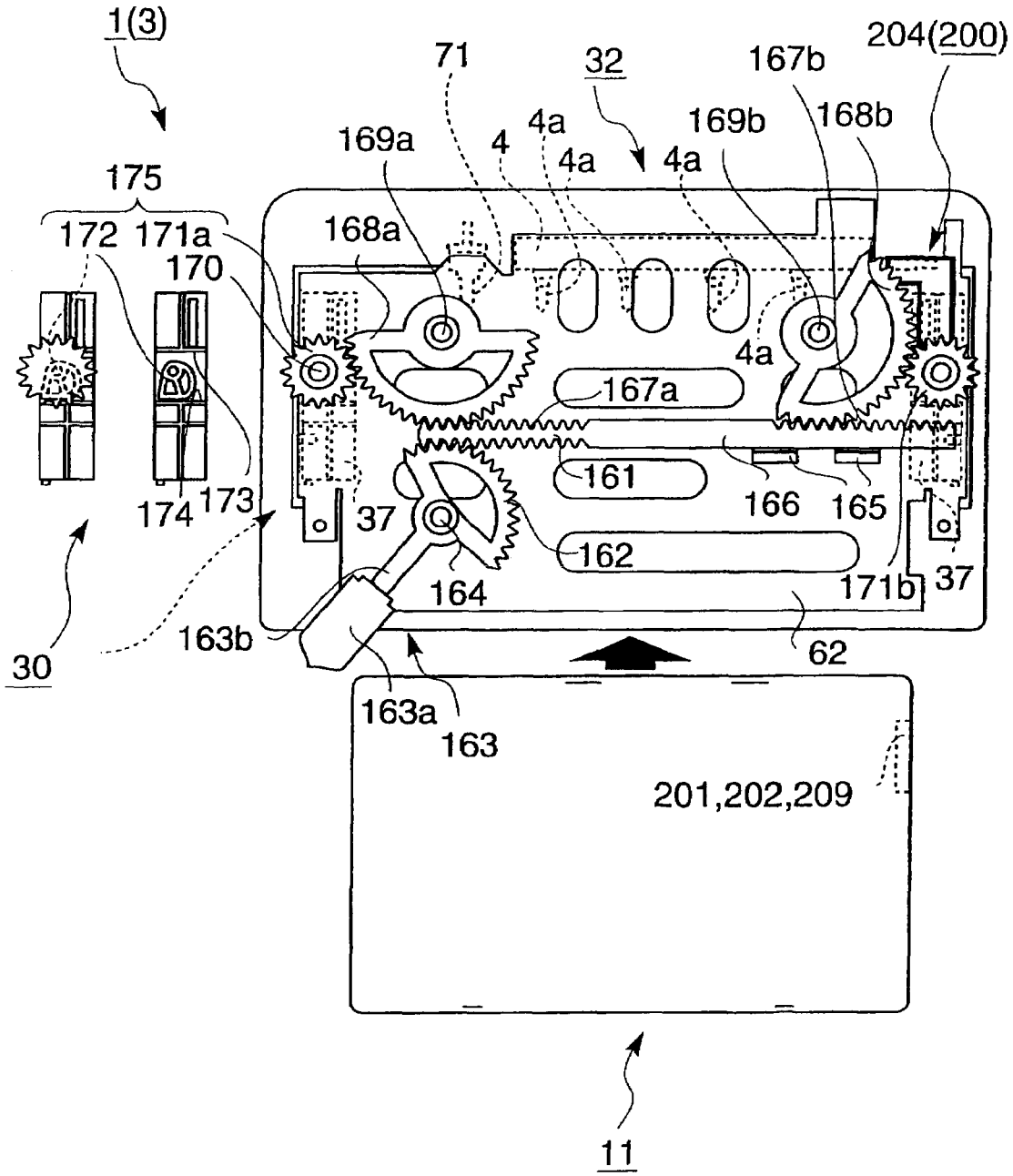
FIG. 2 is a plan view showing an attaching/detaching device before inserting of an ink cartridge in the inkjet printer shown in FIG. 1.

FIG. 2 is a plan view showing the attaching/detaching device before insertion of the ink cartridge.

As shown in FIG. 2, in the cartridge mounting portion 7, a knob 63*a* is provided to an end of the lever arm 163, that is, the arm body 163*b* constituting the attaching/detaching device 1 of the ink cartridge, and a fan-shaped first pinion 162 (as an example of a transmission member) of the power transmission conversion mechanism 32) is provided to the other end of the lever arm to be attached to rotate around a first pivot pin 164 as a supporting point. In addition, with respect to a distance between the supporting point and an operating point for the lever arm 163, a ratio of the distance to a radius of a pitch circle of the first pinion 162 substantially becomes a lever ratio. Therefore, by employing the lever arm 163, the distance between the supporting point and the operating point can be selected to be relatively long, so that a large lever ratio can be obtained.

As an example of the power transmission conversion mechanism 32, a rack, a pinion, and a cam mechanism can be employed. In the embodiment, the power transmission conversion mechanism 32 includes the first pinion 162 which rotates together with the lever arm 163 in one body, a slide bar 166 which has a first rack 161 engaged with the first pinion 162 and a second rack 167 for transmitting a movement of the first rack 161 to a downstream of the transmission path, a second pinion 168 which is engaged with the second rack 167, a gear-attached cam unit 175 which has a gear 171 engaged with the second pinion 168 and an eccentric cam portion 172 for transmitting a rotation of the gear 171 to a downstream of the transmission path in one boy, and a first wall portion 173 which is provided to the cartridge holding means to contact with the eccentric cam portion 172 at a time of moving the ink cartridge 11 in an inserting direction. Here, in FIG. 2, the cartridge holding means 30 shown in the left side of the figure is shown to be drawn out from an inner portion of the recording apparatus for the better understanding of a shape of the eccentric cam portion 172.

In the slide bar 166 according to the embodiment, the first rack 161 is formed on a side facing the first pinion 162, and the second racks 167*a* and 167*b* are formed on a side facing the second pinions 168*a* and 168*b*.In addition, in the second pinion 168*a*, the slide bar is guided to the first pinion 162 and the second pinion 168*a*, and in the second pinion 168*b*, the slide bar is guided to a guide rib 165 provided to a main frame 62 and the second pinion 168*b*, so that the slide bar can reciprocally move in a width direction of the recording apparatus body 3.

Similar to the first pinion 162, the second pinions 168*a* and 168*b* are constructed with fan-shaped gears and rotate around second pivot pins 169*a* and 169*b* as supporting points so as to transmit power to the gears 171*a* and 171*b*, respectively. The gear 171 (171*a* and 171*b*) together with the eccentric cam portion 172 which is formed to be integrated with the gear 171 rotates around a third pivot pin 171 as a supporting point. The eccentric cam portion 172 is constructed to contact with the first wall portion 173 provided to the slider holder 37 of the cartridge holding means 30 and the second wall portion 174 so as to move the slider holder 37.

Next, operations and shapes of the ink cartridge having the aforementioned construction in the attaching/detaching device 1 are described.

Figure 3:
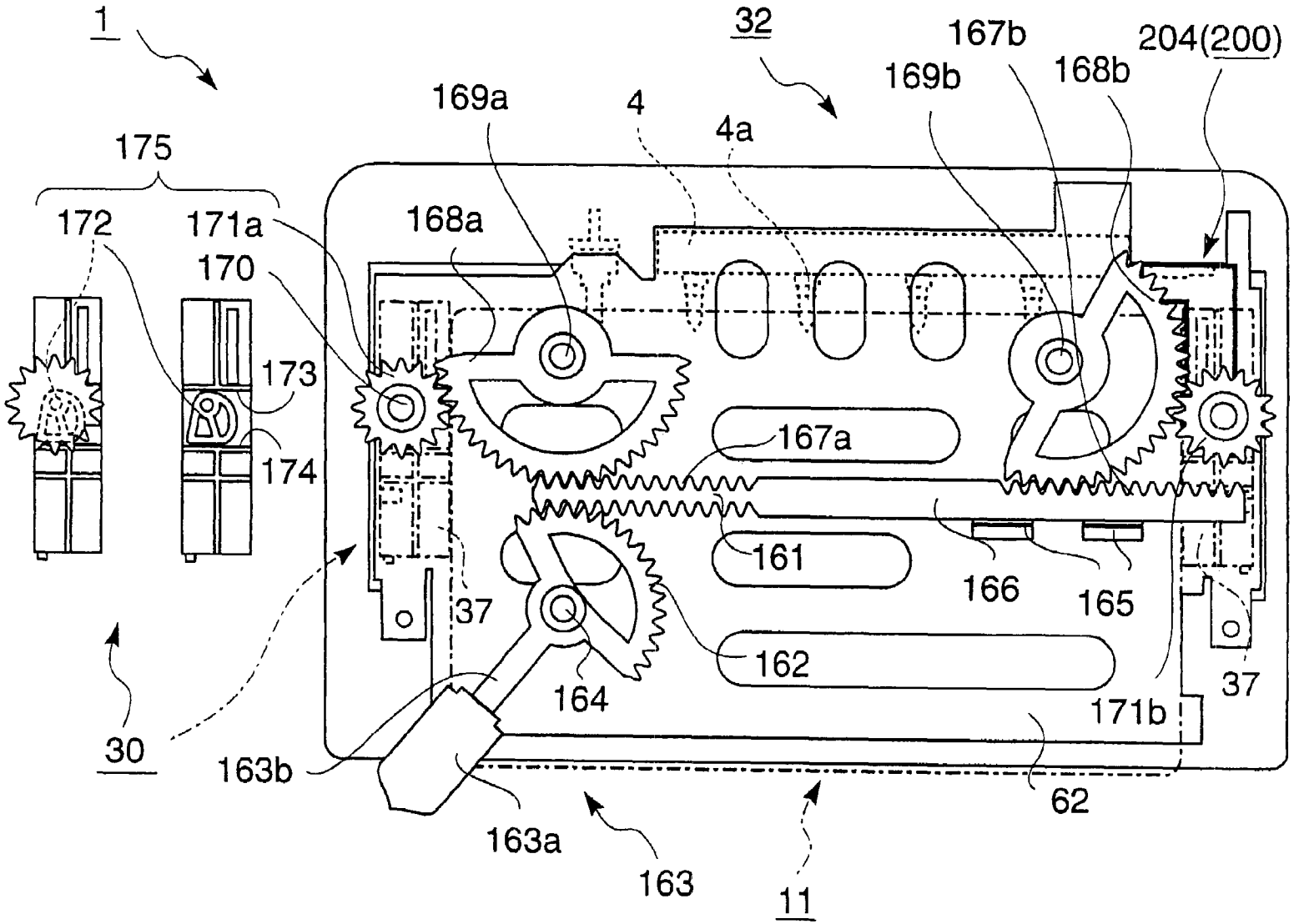
FIG. 3 is a plan view showing the attaching/detaching device in a state where insertion of the ink cartridge is completed in the inkjet printer shown in FIG. 1.

FIG. 3 is a plan view showing the attaching/detaching device in a state where insertion of the ink cartridge is completed.

As shown in FIG. 3, when the ink cartridge 11 is inserted by a predetermined amount thereof, the position of the ink cartridge 11 becomes a position indicated by a one-dot dashed line of the figure. Therefore, when the ink cartridge 11 is inserted, the ink in the ink cartridge 11 is not immediately introduced through the ink supply needle 4*a* formed in the channel member 4 into the recording apparatus body.

Here, the position of the lever arm 163 in a state when the insertion of the ink cartridge is completed is defined as a "reset position".

Figure 4:
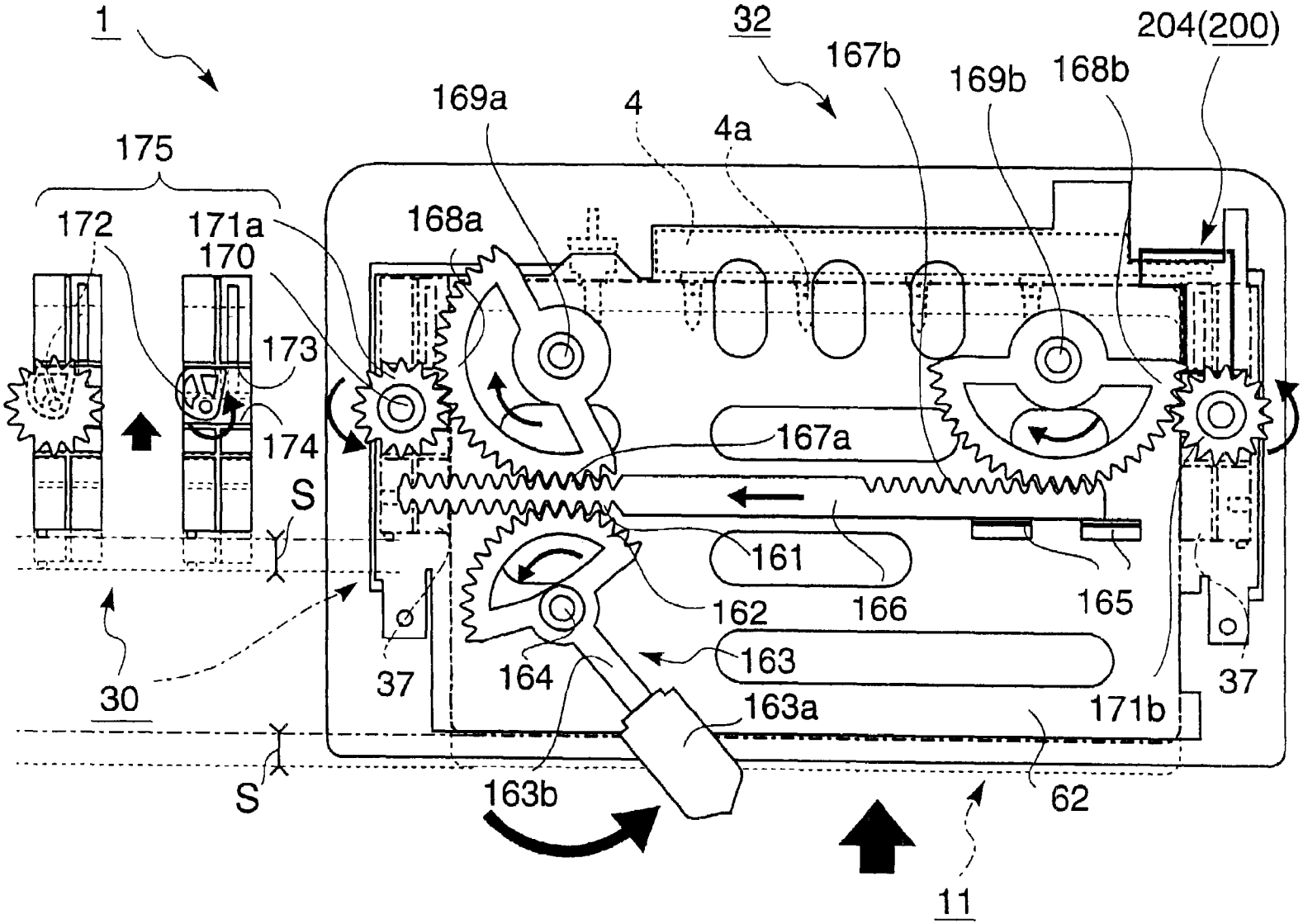
FIG. 4 is a plan view showing the attaching/detaching device in a state where mounting of the ink cartridge is completed in the inkjet printer shown in FIG. 1.

FIG. 4 is a plan view showing the attaching/detaching device in a state where mounting of the ink cartridge is completed.

As shown in FIG. 4, when the lever arm 163 is rotated from the "reset position" in a right side shown in FIG. 3, the rotation movement is transmitted through the aforementioned power transmission conversion mechanism 32 to rotate the eccentric cam portion 172. Next, the eccentric cam portion 172 contacts with the first wall portion 173 provided to the slider holder 37 of the cartridge holding means 30 to move the slider holder 37 to perform conversion into a motion for inserting the cartridge holding means 30 by the second stroke S.

At this time, when the knob 163*a* of the lever arm 163 is moved to the leftmost side, the ink cartridge is entered into the inner portion again, so that the ink supply needle 4*a* formed in the channel member 4 is inserted into a needle insertion opening of the ink cartridge 11. As a result, the state where the mounting of the ink cartridge 11 is completed is formed.

Here, the position of the lever arm 163 in the state where the mounting of the ink cartridge is completed is defined as a "set position".

In addition, the lever arm 163 is rotated from the "reset position" to the "set position", and when the ink cartridge is mounted, the ink cartridge 11 is arranged to contact with the contact device 200 provided to the cartridge mounting portion 7 of the recording apparatus body.

Here, the contact device 200 is a device for contacting a later-described connection terminal portion 202 (FIG. 5) of the ink cartridge with a connector 203 (FIG. 6) of the recording apparatus.

Next, the contact device 200 is described.

Figure 5:
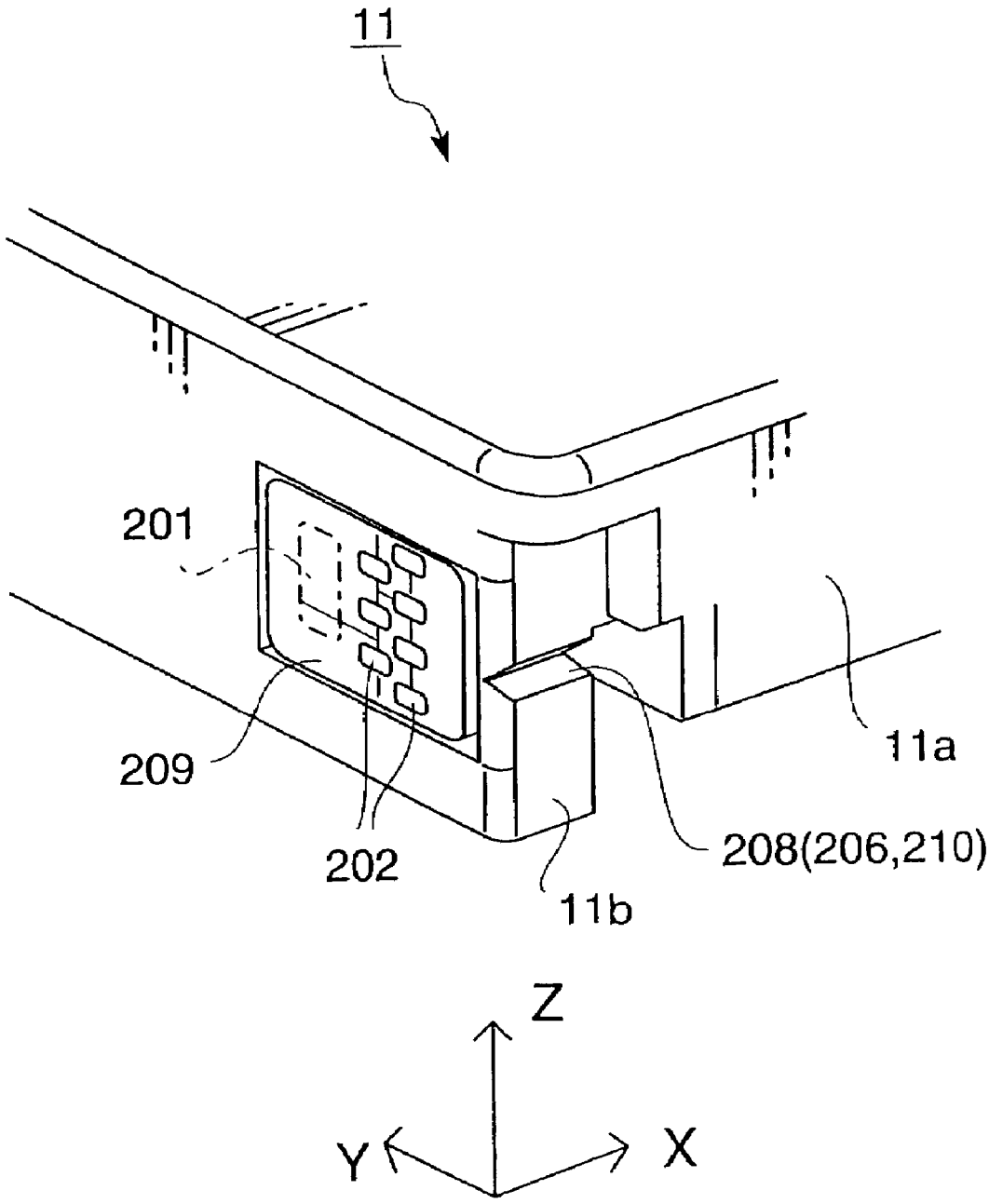
FIG. 5 is an enlarged perspective view of main components of an ink cartridge according to an embodiment of the present invention.

FIG. 5 is an enlarged perspective view of main components of the ink cartridge according to the present invention.

As shown in FIG. 5, an inserting direction contact surface 11*b* which contacts with a portion facing the inserting direction in the cartridge mounting portion 7 is provided to the one of two sides of the inserting direction front end side 11*a* of the ink cartridge 11, and a concave portion 208 is provided to the inserting direction contact surface 11*b*. In addition, a storage device 201 which stores information on a remaining ink amount and a substrate 209 having a plurality of connection terminal portions 202 connected to the storage device 201 are provided to a side surface of the ink cartridge 11 near the inserting direction contact surface 11*b*.

Figure 6:
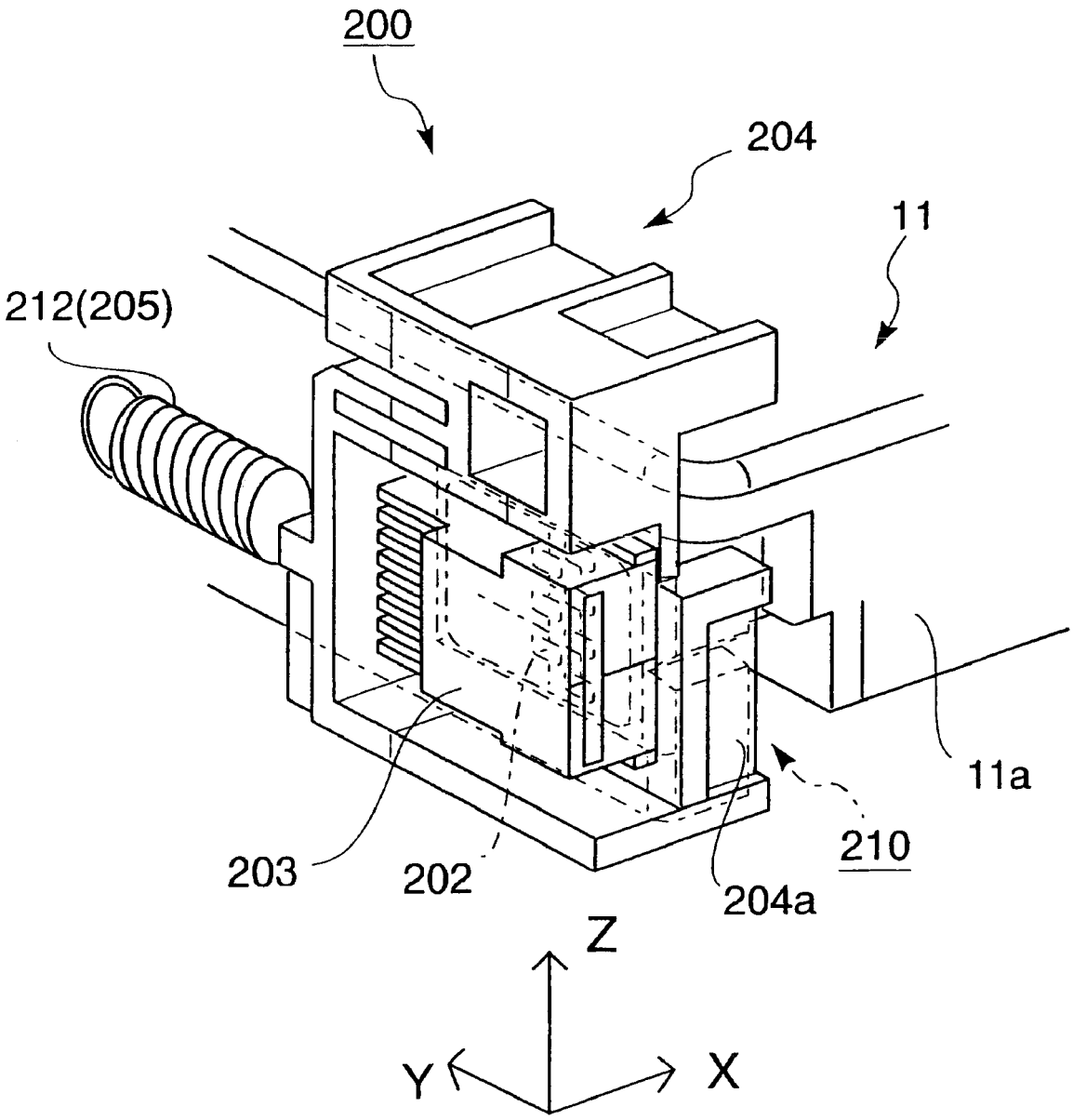
FIG. 6 is a perspective view showing a state where an ink cartridge of a contact device according to the embodiment is mounted.
Figure 7:
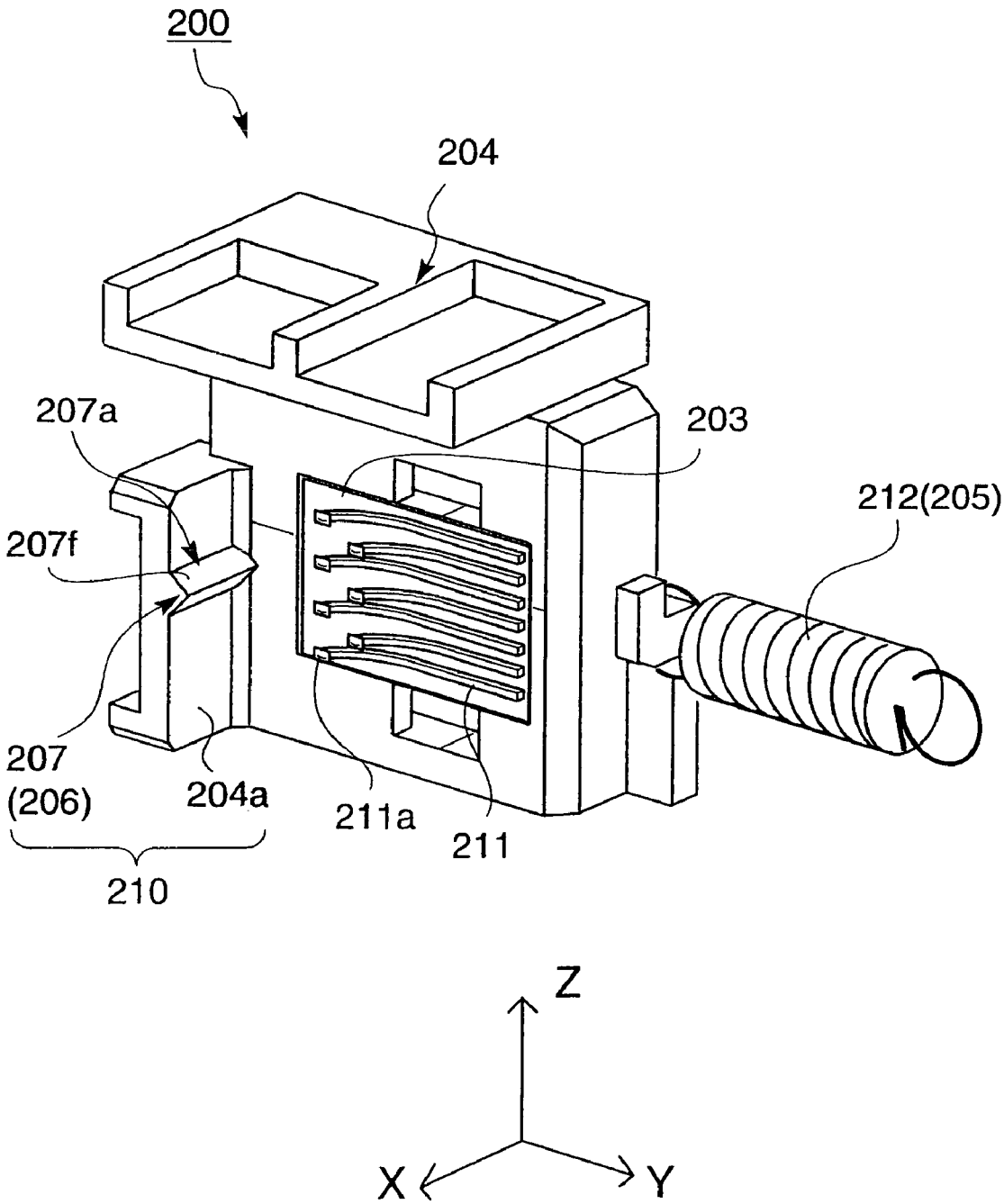
FIG. 7 is a perspective view showing a contact device according to the present invention as seen from the ink cartridge.

FIG. 6 is a perspective view showing a state where the ink cartridge of the contact device according to the present invention. FIG. 7 is a perspective view showing the contact device according to the present invention as seen from the ink cartridge.

As shown in FIG. 6, the contact device 200 includes the connector 203 which can contact with the connection terminal portions 202, a holder 204 which holds and the connector 203 and can move, and a holder spring 212 having the one end fixed to the holder 204 and the other end fixed to the recording apparatus body 3 so as to press the holder 204 against the inserting direction of the ink cartridge 11.

As shown in FIG. 7, a contact portion 204*a* which can contact with the inserting direction contact surface 11*b* of the ink cartridge 11 when the ink cartridge 11 is mounted is provided to the holder 204. In addition, a convex portion 207 which can be engaged with the concave portion 208 formed on the inserting direction contact surface 11*b* of the ink cartridge 11 is provided to the contact portion 204*a*. Here, the convex portion 207 is a protrusion 207*a* which is formed to extend in an X-axis direction, that is, a width direction of the ink cartridge 11.

In addition, pin-shaped terminals 211 which can contact with the connection terminal portions 202 of the ink cartridge are provided to the connector 203 which is held by the holder 204. As described later, the pin-shaped terminals 211 is constructed in a form of a pin spring which can press toward the connection terminal portions 202.

FIGS. 8(A) to (C) are cross sectional side views showing movement of the contact device according to the present invention when the ink cartridge is mounted. FIG. 8(A) shows a state before the ink cartridge 11 contacts with the holder 204, FIG. 8(B) shows a state where the ink cartridge contacts with the holder, and FIG. 8(C) show a state where the ink cartridge in the contacted state of (B) moves and stops, that is, a state where the mounting of the ink cartridge is completed.

As shown in FIG. 8(A), when the lever arm 163 is moved from the "reset position" to the "set position", the ink cartridge 11 is moved in the inserting/mounting direction.

Next, when the lever arm 163 is moved to the "set position", the inserting direction contact surface 11*b* of the ink cartridge 11 contacts with the contact portion 204*a* of the holder 204 as shown in FIG. 8(B). At this time, the protrusion 207*a*, this is, the convex portion 207 formed on the contact portion 204*a* is guided by a slanted portion 207*f* formed on the protrusion 207*a* to be engaged with the concave portion 208 of the ink cartridge 11.

Figure 8:
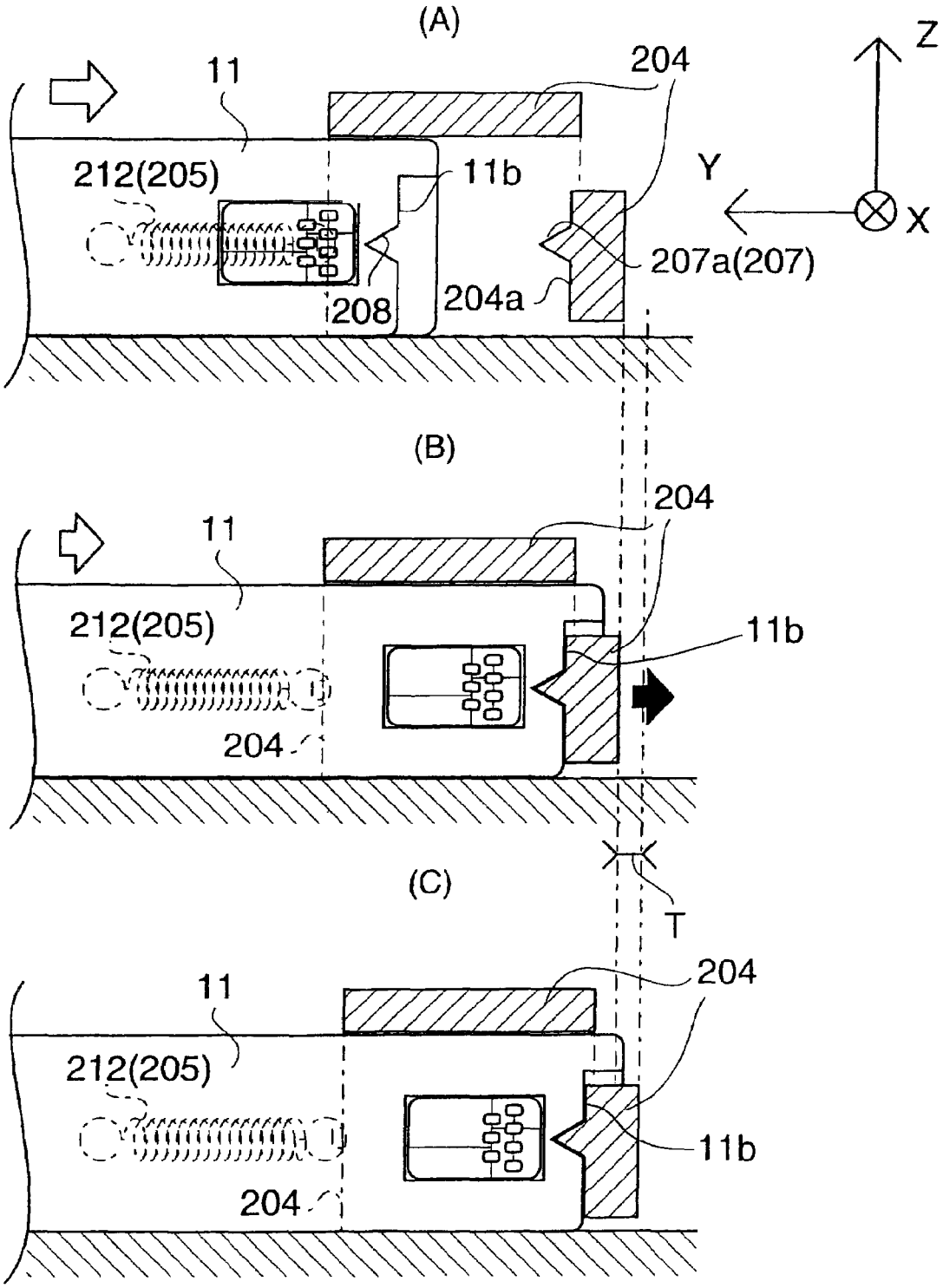
FIG. 8 is a cross sectional side view showing a movement of a contact device according to the present invention when an ink cartridge is mounted, (A) shows a state before the ink cartridge contacts with a holder, (B) shows a state where the ink cartridge contacts with the holder, and (C) show a state where the ink cartridge in the contacted state of (B) moves and stops, that is, a state where the mounting of the ink cartridge is completed.

Next, when the lever arm 163 is moved to the "set position", the ink cartridge 11 is moved from the state of FIG. 8(B) by a distance T and stops, as shown in FIG. 8 (C). As a result, the state where the mounting of the ink cartridge 11 is completed is obtained. Here, a relation between the distance T and the second predetermined stroke S (see FIG. 4) is designed to satisfy the flowing equation.

Distance T<Second Predetermined Stroke S

Next, when the ink cartridge 11 is moved from the state of FIG. 8(B) to the state of FIG. 8(C) by the distance T, the ink cartridge 11 is moved against a spring force of the a holder spring 212 of which one end is fixed to the holder 204. Here, the holder 204 is arranged to move, and thus, the holder 204 can follow the movement of the ink cartridge 11 by the distance T according to the spring force of the holder spring 212.

Therefore, at the state where the ink cartridge 11 is stopped and the mounting thereof is completed, the contact portion 204*a* of the holder 204 can contact with the ink cartridge 11 without any gap. In other words, it is possible to determine a relative position between the ink cartridge 11 and the holder 204 in a Y-axis direction, that is, the inserting/mounting direction.

Here, the position shown in FIG. 8(C) is a reference position at the time of mounting the ink cartridge, and the holder 204 is arranged to move by a distance±T in the Y-axis direction from the reference position. Therefore, even in a case where a variation of the position of the ink cartridge 11 from the reference position in the Y-axis direction in a range of the distance±T occurs, the holder 204 can follow the position thereof to determine the relative positional relation. In addition, in the embodiment, the substrate 209 has a very small size of about 5 mm×5 mm, and the distance T of the movement of the holder 204 is 1 mm.

Figure 9:
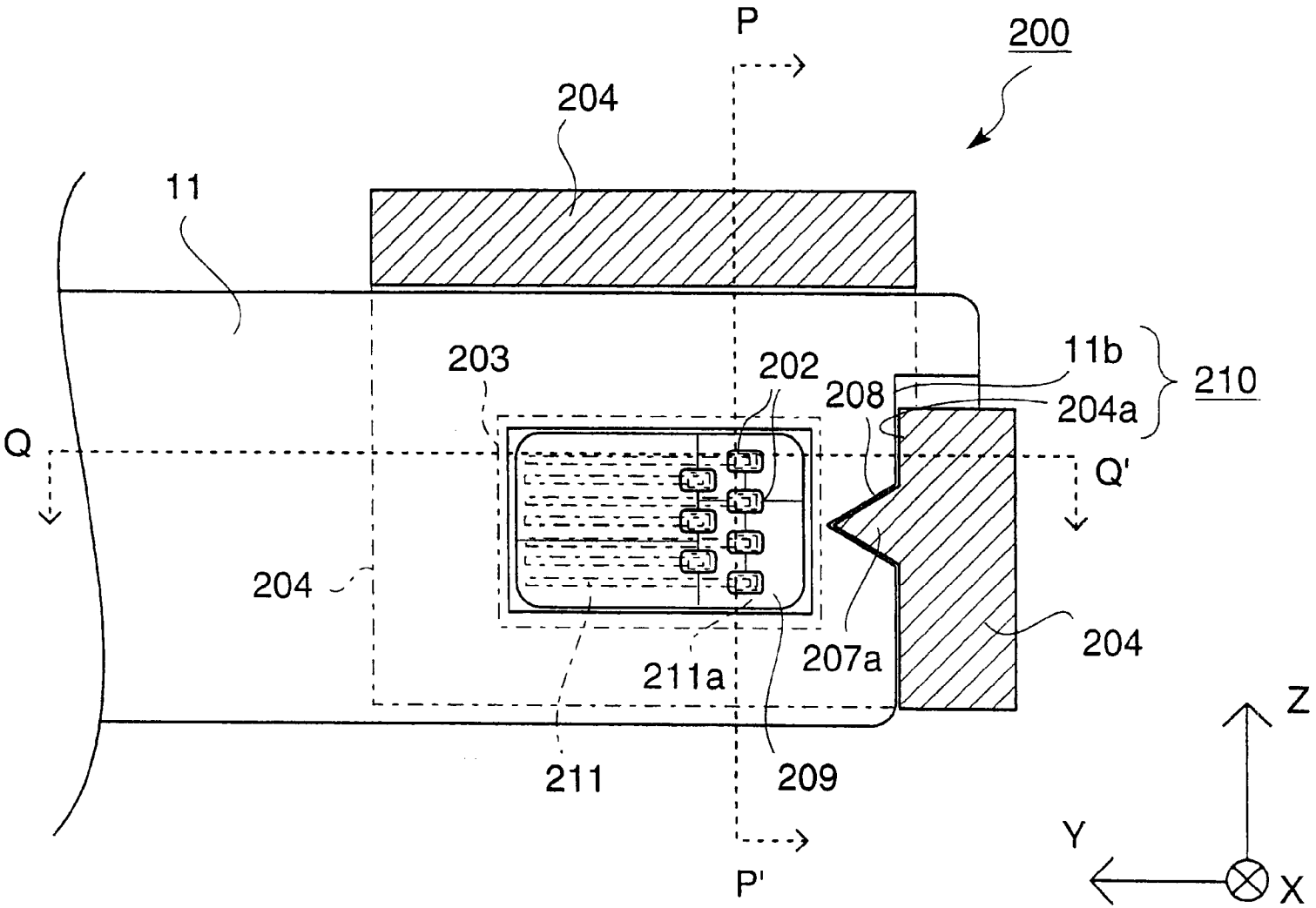
FIG. 9 is a cross sectional side view showing a contact device and an ink cartridge according to the present invention at a state where the ink cartridge is mounted.

In addition, the protrusion 207*a*, that is, the convex portion 207 is provided to the contact portion 204*a*, and the protrusion 207*a* can be engaged with the concave portion 208 of the ink cartridge without any gap. Namely, it is possible to determine the relative position relation between the ink cartridge 11 and the holder 204 in the Z-axis direction. FIG. 9 is an enlarged view of FIG. 8(C).

FIG. 9 is a cross sectional side view showing the contact device and the ink cartridge according to the present invention at the state where the ink cartridge 11 is mounted.

As shown in FIG. 9, the relative position relation between the ink cartridge 11 and the holder 204 in the Y-axis and Z-axis directions can be determined. Therefore, the connection terminal portions 202 provided to the substrate 209 of the ink cartridge and the front end portions 211*a* of the pin-shaped terminals 211 provided to the connector 203 of the holder have a positional relation to face each other. Here, a cross section taken along dashed line Q-Q' of the figure is shown in FIG. 10, and a cross section taken along dashed line P-P' is shown in FIG. 11.

Figure 10:
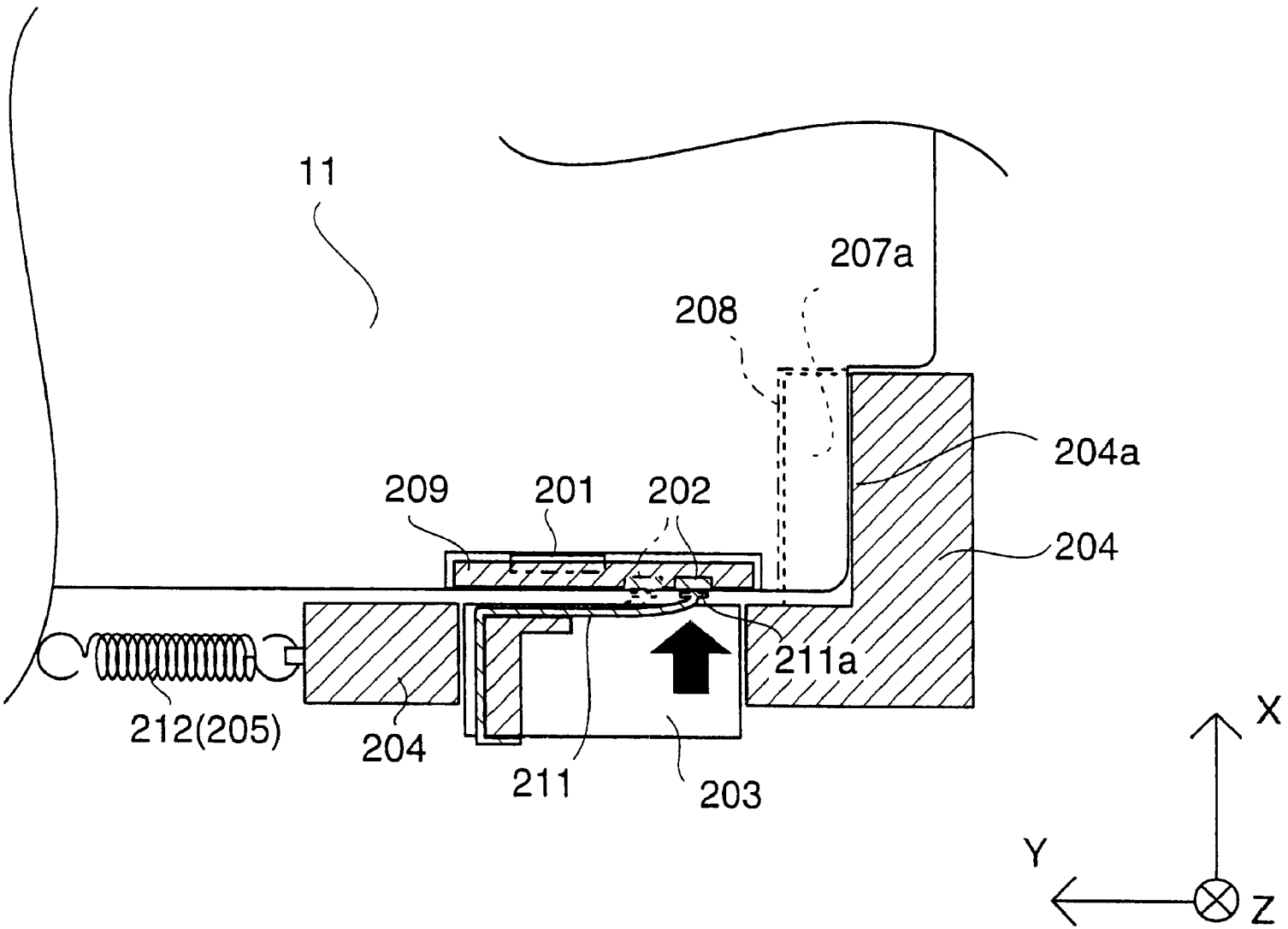
FIG. 10 is a cross sectional plan view of the contact device and the ink cartridge of FIG. 9.
Figure 11:
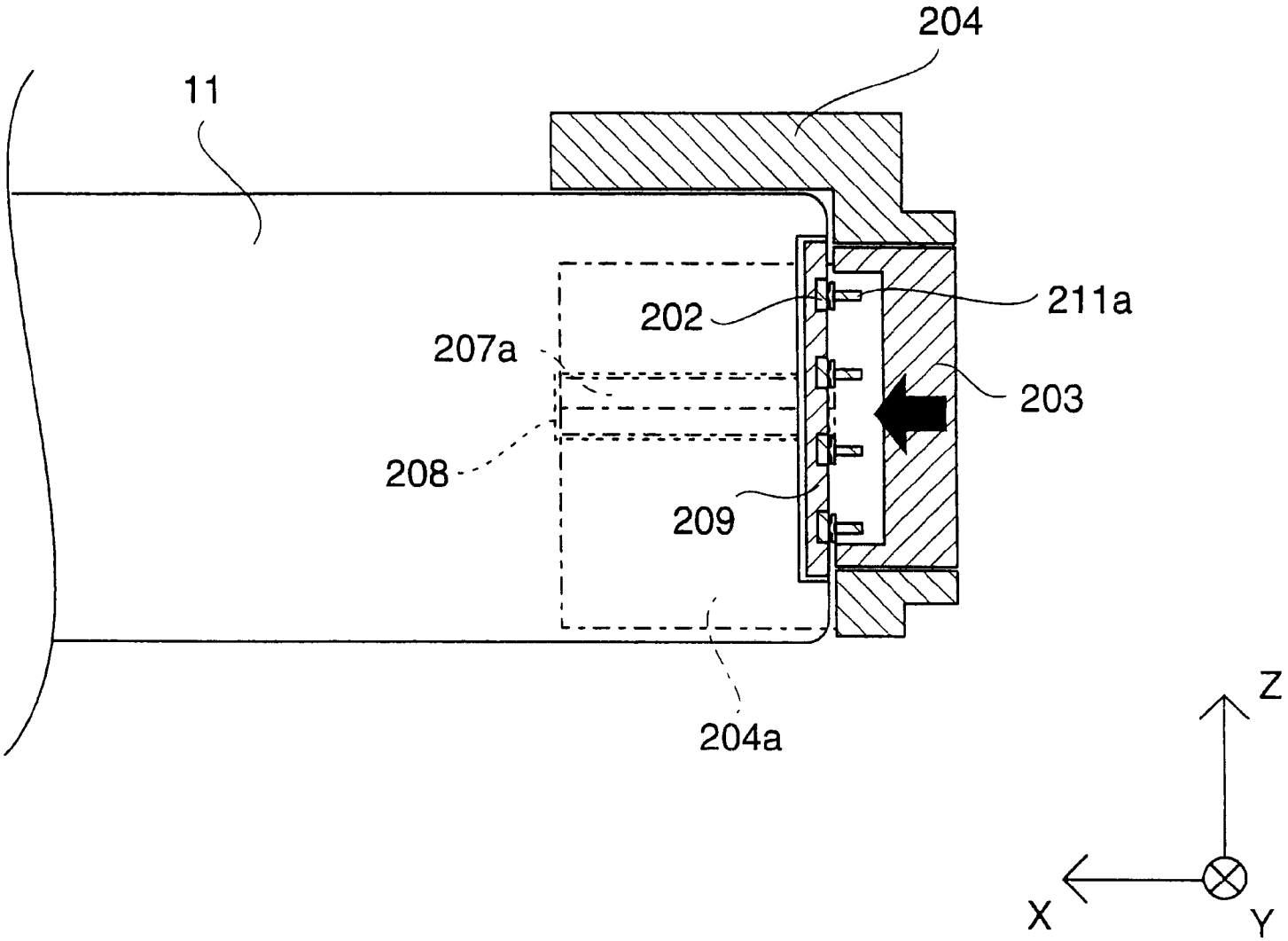
FIG. 11 is a cross sectional front view of the contact device and the ink cartridge of FIG. 9.

FIG. 10 is a cross sectional plan view of the contact device and the ink cartridge of FIG. 9.

As shown in FIG. 10, when the connection terminal portions 202 provided to the substrate 209 of the ink cartridge and the front end portions 211*a* of the pin-shaped terminals 211 provided to the connector 203 of the holder have a positional relation to face each other, the front end portions 211*a* of the pin-shaped terminals 211 are electrically connected to the connection terminal portions 202. Here, the pin-shaped terminals 211 are constructed in a form of a pin spring which can press toward the facing connection terminal portions 202, that is, in the X-axis direction.

Therefore, in the X-axis direction, even in a case where a gap between the ink cartridge 11 and the holder 204 occurs, the pin-shaped terminals 211 can be surely electrically connected to the connection terminal portions 202.

FIG. is a cross sectional front view of the contact device and the ink cartridge of FIG. 9.

As shown in FIG. 11, the concave portion 208 of the ink cartridge and the portion 207*a*, that is, the convex portion 207 of the holder are arranged to extend in a direction perpendicular to the substrate 209. Therefore, when the front end portions 211*a* of the pin-shaped terminals 211 provided to the connector 203 of the holder and the connection terminal portions 202 provided to the substrate of the ink cartridge has a positional relation to face each other, the surface of the substrate 209 can be arranged to be parallel to the surface of the connector 203. Namely, one side thereof cannot be slanted.

Here, in a case where a plurality of the connection terminal portions 202 and a plurality of the pin-shaped terminals 211 are provided, since the surface of the substrate 209 are arranged to be parallel to the surface of the connector 203, all the pin-shaped terminals 211 can be electrically connected to all the connection terminal portions 202.

In the embodiment, the contact device 200 of the connection terminal portion 202 of the ink cartridge and the connector 203 oft the recording apparatus is a contact device 200 for contacting an electrical connection terminal portion 202 provided to the ink cartridge to be connected to a storage device 202 which stores information on a remaining ink amount with a connector 203 provided to the recording apparatus to contact with the connection terminal portion 202. In addition, the contact device is provided with a holder 202 which holds the connector 203 and can move with respect to the recording apparatus. In addition, the contact device includes a relative positioning unit 210 which determine a relative position between the ink cartridge 11 and the holder 204 at a time of mounting the ink cartridge 11 by contacting the ink cartridge 11 with the holder 204 and moving the holder 204 in the inserting/mounting direction (Y-axis direction) of the ink cartridge 11.

As a result, at the time of the mounting the ink cartridge 11, by contacting the ink cartridge 11 with the holder 204 and moving the holder 204 in the inserting/mounting direction (Y-axis direction) of the ink cartridge 11, the relative position between the ink cartridge 11 and the holder 204 can be determined.

Therefore, it is possible to surely contact the connection terminal portion 202 of the ink cartridge with the connector 203 of the recording apparatus body. Namely, it is possible to electrically connect the connection terminal portion 202 to the connector 203. In addition, the recording apparatus body 3 can read the information on the remaining ink amount from the storage device 201 of the ink cartridge or write the information on the remaining ink amount to the storage device 201.

For example, when a force for pushing out the ink supply needle 4*a* is exerted on the needle insertion opening of the ink cartridge thorough which the ink supply needle 4*a* is inserted, the ink cartridge 11 intends to move in a direction opposite to the inserting/mounting direction of the ink cartridge 11. In this case, if the holder is fixed similarly to a conventional one, the connection terminal portion 202 and the connector 203 may be electrically disconnected from each other.

However, even in the case, since the contact device 200 according to the embodiment is provided with the relative positioning unit 210, the connection terminal portion 202 and the connector 203 cannot be electrically disconnected from each other.

The relative positioning unit 210 according to the embodiment includes the contact portion 204*a* which contacts with the inserting direction contact surface 11*b* of the ink cartridge 11 and the holder 204 which has the holder spring 212, that is, the pressing means 205 for pressing the contact portion 204*a* against the movement of the ink cartridge 11 when the ink cartridge 11 is mounted.

As a result, it is possible to determine the relative positional relation between the ink cartridge 11 and the holder 204 with a high accuracy and a simple construction in the inserting/mounting direction (Y-axis direction) of the ink cartridge 11.

In addition, in the embodiment, engagement means 206 are provided to a position where the contact portion 204*a* contacts with the liquid cartridge 11. A cone-shaped convex portion 207 is provided to one of the engagement means 296 to be pointed toward the other thereof, and a concave portion 208 which is engaged with the convex portion 207 is provided to the other thereof. Sine the convex portion has a shape of cone, the convex portion 207 has a slanted portion 207*f*.

Here, "the cone-shaped convex portion 207 which is pointed toward the other thereof" is defined as a convex portion having a slanted surface so as to be pointed toward the front end side of the cone irrespective of whether or not the front end side of the convex portion is sharply pointed.

As a result, the convex portion 207 is guided by the slanted portion 207*f* to be engaged with the concave portion 208. Namely, it is possible to restrict the relative positional relation between the ink cartridge 11 and the holder 204 in the slanted direction of the slanted portion 207*f*. In the embodiment, the slanted portion 207*f* is arranged to be slanted toward the height direction (Z-axis direction) of the ink cartridge 11, and it is possible to restrict the relative positional relation between the ink cartridge 11 and the holder 204 in the height direction (Z-axis direction) thereof.

In addition, the connector 203 includes the pin-shaped terminal 211 which can contact with the connection terminal portion 202. The pin-shaped terminals 211 is constructed in a form of a pin spring which can press toward the connection terminal portions 202 when the connection terminal portion 202 and the connector 203 have a positional relation to face each other.

As a result, when the connection terminal portion 202 and the connector 203 have a positional relation to face each other, the pin-shaped terminal 211 can securely contact with the connection terminal portion 202. Namely, even in a case where a variation in the relative positional relation between the ink cartridge 11 and the holder 204 in the X-axis direction occurs, since the pin-shaped terminal 211 can press toward the connection terminal portion 202, so that some degree of variation is tolerable.

In a case where a plurality of the pin-shaped terminals 211 are provided, a total pressing force of the pin-shaped terminals 211 is a product of a unit pressing force and the number of the pin-shaped terminals. In addition, when the ink cartridge 11 is mounted, the pressing force of the pin-shaped terminal 211 may be exerted against the movement of the ink cartridge 11. In addition, after the ink cartridge is mounted, the ink cartridge 11 may be pressed toward a direction (Y-axis direction) where the ink cartridge 11 is detached, so that the mounting thereof may be incompletely performed. In other words, the ink supply needle 4*a* may not completely be inserted into the ink cartridge 11.

For the reasons, in the embodiments, a plurality of the pin-shaped terminals 211 are provided. On the other hand, the number of the connection terminal portions 202 which can contact with the pin-shaped terminals 211 are arranged to be equal to the number of the pin-shaped terminals 211 on the substrate 209. In addition, the substrate 209 is disposed on a surface parallel to the mounting direction (Y-axis direction) of the ink cartridge 11 so as to face the connector 203 when the ink cartridge 11 is mounted. Namely, the inserting/mounting direction (Y-axis direction) of the ink cartridge 11 is perpendicular to a direction (X-axis direction) perpendicular to the substrate 209, that is, the pressing direction of the pin-shaped terminal 211.

As a result, when the ink cartridge is mounted, the pressing force of the pin-shaped terminal 211 cannot be exerted against the movement of the ink cartridge 11. In addition, after the ink cartridge is mounted, the ink cartridge 11 cannot be pressed toward the direction (Y-axis direction) where the ink cartridge 11 is detached, so that the mounting thereof cannot be incompletely performed.

The convex portion 207 according to the embodiment is a protrusion 207*a* which is formed to extend in a direction (X-axis direction) perpendicular to the substrate 209.

As a result, in a case where the convex portion 207 is formed to extend in the direction (X-axis direction) perpendicular to the substrate 209, it is possible to restrict the positional relation between the ink cartridge 11 and the holder 204 in a direction (Z-axis direction) perpendicular to the direction (X-axis direction) perpendicular to the substrate 209 and to reduce distortion caused from a tolerance of components. Namely, the convex portion 207 allows the substrate 209 to face the connector 203 in parallel. As a result, it is possible to securely contact a plurality of the pin-shaped terminals 211 with the connection terminal portions 202 having the number equal to the number of the pin-shaped terminals 211 individually.

The above description is made on the operations associated with a case where the lever arm 163 is moved from the "reset position" to the set position" to mount the ink cartridge 11. On the contrary, in a case where the ink cartridge 11 is detached, the lever arm 163 may be moved from the "set position" to the "reset position". At this time, the ink cartridge 11 is arranged to move toward a direction where the ink cartridge is detached from the recording apparatus body 3 by a spring force of the spring provided to the cartridge holding means 30.

Therefore, when the lever arm 163 is moved from "set position" to the "reset position", the eccentric cam portion 172 contacts with the second wall portion 174 provided to the slider holder 37 of the cartridge holding means 30 to move the slider holder 37 from the position shown in FIG. 4 to the position shown in FIG. 3. Accordingly, the ink cartridge 11 and the holder 204 of the contact device 200 become the state shown in FIG. 8(B) from the state shown in FIG. 8(C). In turn, these components become the state before the ink cartridge 11 is mounted, as shown in FIG. 8(C).

More specifically, when the lever arm 163 is gradually moved from "set position" to the "reset position", the ink cartridge 11 together with the cartridge holding means 30 and 30 moves from the state shown in FIG. 8(C) that the mounting is completed to the position shown in FIG. 8(B).

At this time, since the holder 204 is pressed toward to the ink cartridge 11 by the holder spring 212, the holder 204 together with the ink cartridge 11 moves by the distance T. As described above, since the holder 204 is allowed to move from the reference position shown in FIG. 8 (*c*) in the Y-axis direction in only the range of the distance ± T, when the ink cartridge 11 is moved in the detaching direction further from the position shown in FIG. 8(B), the holder 204 is stopped and separated from the ink cartridge 11, as shown in FIG. 8(A). Next, the ink cartridge 11 is released from the state that the ink cartridge is held by the cartridge holding means 30, so that the ink cartridge can be detached by the pressing force of the spring provided to the cartridge holding means 30.

First Modified Embodiment

Next, a contact device according to a first modified embodiment is described with reference to FIG. 12.

Figure 12:
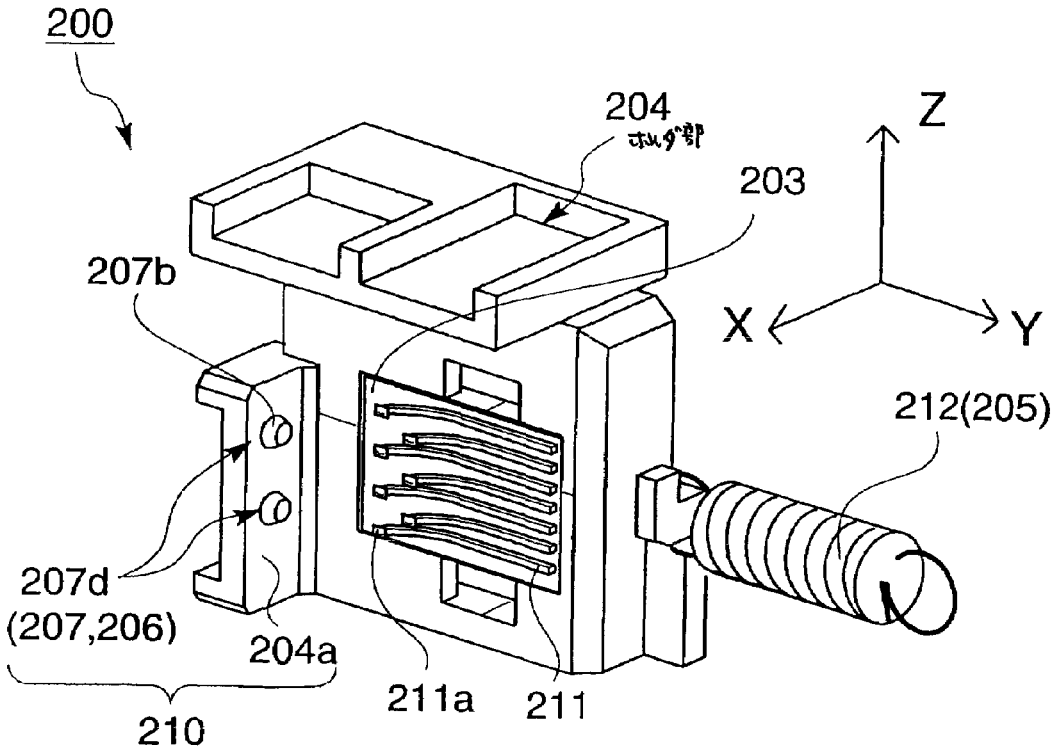
FIG. 12 is a perspective view showing a contact device according to a first modified embodiment.

FIG. 12 is a perspective view showing the contact device according to the first modified embodiment.

As shown in FIG. 12, the contact portion 204*a* of the holder 204 is provided with the first convex portion 207*d*, and the first slanted portion 207*b*, that is, a slanted surface of the first convex portion 207*d* is formed to be similar to a slanted surface of a cone. Namely, the first convex portion 207*d* has a shape of a frustum of a cone. Here, "to be similar to a slanted surface of a cone" denotes that the slanted surface of the first convex portion 207*d* is pointed toward the front end side of the first convex portion 207*d* (toward the concave portion) similar to the curved slanted surface of the cone. In addition, the front end side of the first convex portion 207*d* may not necessarily be sharply pointed.

Therefore, since the first convex portion 207*d* has a slanted surface on the circumference thereof, the first convex portion 207*d* can determine the relative positional relation between the ink cartridge 11 and the holder 204 in the X-axis and Z-axis direction. At this time, even in a case where the first convex portion 207*d* is engaged with the concave portion 208, distortion occurs around the shaft of the first convex portion 207*d*, so that the surface of the substrate 209 of the ink cartridge may not face the surface of the connector 203 facing the substrate 209 in parallel. In this case, a plurality of the first convex portions 207*d* and a plurality of the concave portions 208 engaged with the first convex portions are provided, so that the distortion may not occur. Therefore, the surface of the substrate 209 is allowed to face the surface of the connector 203 facing the substrate 209 in parallel.

In addition, the first convex portion 207*d* may be formed to be elongated in the X-axis or Z-axis direction. In other words, the first convex portion may be formed to have a shape of an ellipse.

Other components and operations and effects thereof are the same as those described with reference to FIGS. 5 to 11, and thus, description thereof is omitted.

In the first modified embodiment, the first convex portion 207*d* which is the cone-shaped convex portion 207 of the engagement means 206 is provided with the first slanted portion 207*b*, and the first slanted portion 207*b* is formed to be similar to a slanted surface of a cone. Namely, the first slanted portion 207*b* is formed in all the directions perpendicular to the inserting/mounting direction (Y-axis direction) of the ink cartridge 11.

As a result, it is possible to determine the relative positional relation between the ink cartridge 11 and the holder 204 in a direction (X-axis and Z-axis directions) perpendicular to the inserting/mounting direction (Y-axis direction) of the ink cartridge 11, Second Modified Embodiment Next, a contact device according to a second modified embodiment is described with reference to FIG. 13.

Figure 13:
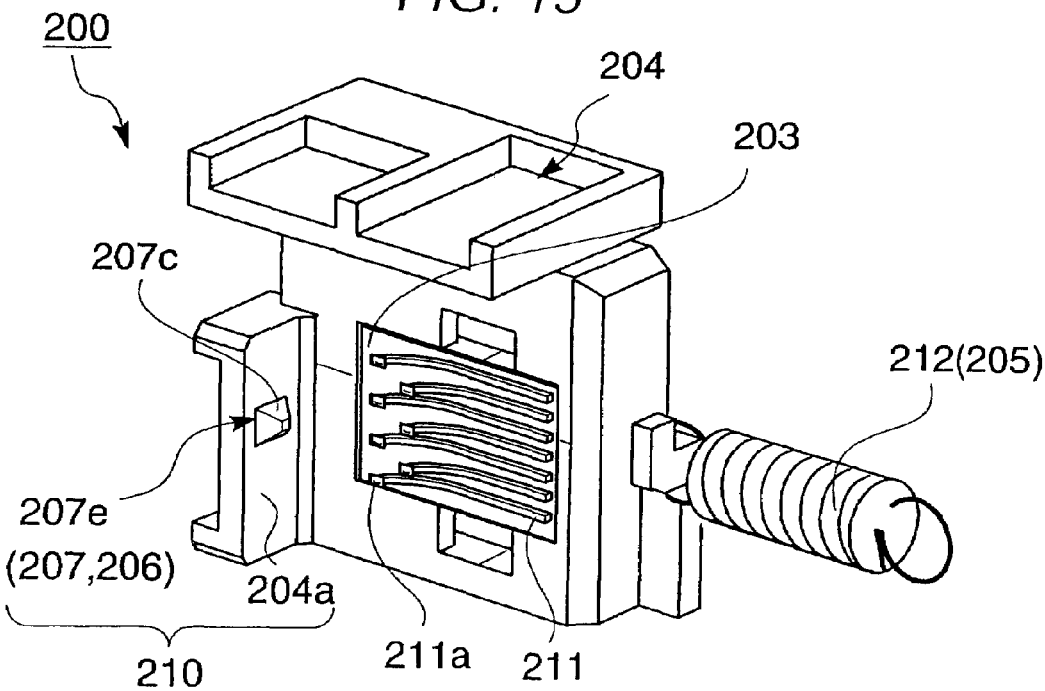
FIG. 13 is a perspective view showing a contact device according to a second modified embodiment.

FIG. 13 is a perspective view showing the contact device according to the second modified embodiment.

As shown in FIG. 13, the contact portion 204*a* of the holder 204 is provided with the second convex portion 207*e*, and the second slanted portion 207*c*, that is, a slanted surface of the second convex portion 207*e* is formed to be similar to a slanted surface of a quadrangular pyramid. Here, "to be similar to a slanted surface of a quadrangular pyramid" denotes that the slanted surface of the second convex portion 207*e* is pointed toward the front end side of the second convex portion 207*e* (toward the concave portion) similar to the slanted surface of the quadrangular pyramid. In addition, the front end side of the second convex portion 207*e* may not necessarily be sharply pointed.

Therefore, similar to the first convex portion 207*d* of the first modified embodiment shown in FIG. 12, it is possible to determine the relative positional relation between the ink cartridge 11 and the holder 204 in the X-axis and Y-axis directions. Unlike the first convex portion 207*d*, even in a case where the second convex portion 207*e* is engaged with the concave portion 208, distortion may not occur around the shaft of the second convex portion 207*e*. Therefore, unlike the first modified embodiment, there is no need to provide a plurality of the first convex portions 207*d*.

Here, the second slanted portion 207*c*, that is, the slanted surface of the second convex portion 207*e* is formed to be similar to the slanted surface of the quadrangular pyramid, but not limited to the quadrangular pyramid. The same operations and effects may be obtained by using any polygonal pyramids.

Other components and operations and effects thereof are the same as those described with reference to FIGS. 5 to 11, and thus, description thereof is omitted.

In the second modified embodiment, the second convex portion 207*e* which is the cone-shaped convex portion 207 of the engagement means 206 is provided with the second slanted portion 207*c*, and the second slanted portion 207*c* is formed to be similar to a slanted surface of a polygonal pyramid. Namely, when the second convex portion 207*e* is engaged with the concave portion 208, the second convex portion 207*e* is guided toward a vertex of the polygonal pyramid with respect to the concave portion 208 by the second slanted portion 207*c* formed to be similar to the slanted surface of the polygonal pyramid in a direction (X-axis and Y-axis directions) perpendicular to the inserting/mounting direction (Y-axis direction) of the ink cartridge 11.

As a result, it is possible to determine the relative positional relation between the ink cartridge 11 and the holder 204 in a direction (X-axis and Z-axis directions) perpendicular to the mounting direction (Y-axis direction) of the ink cartridge 11.

In addition, since the second slanted portion 207*c* is formed to be similar to the surface of the polygonal pyramid, the second slanted portion 207*c* cannot be engaged with the concave portion 208 in a distorted state thereof around the inserting/mounting direction (Y-axis direction) of the ink cartridge 11 as a shaft. Namely, the ink cartridge 11 and the holder 204 cannot contact with each other in a distorted state around the inserting/mounting direction (Y-axis direction) of the ink cartridge 11 as a shaft. Accordingly, the second slanted portion 207*c* allows the substrate 209 of the ink cartridge and the connector 203 of the recording apparatus body to face each other in parallel so as to securely contact with each other.

Third Modified Embodiment

Next, a contact device according to a third modified embodiment is described.

Figure 14:
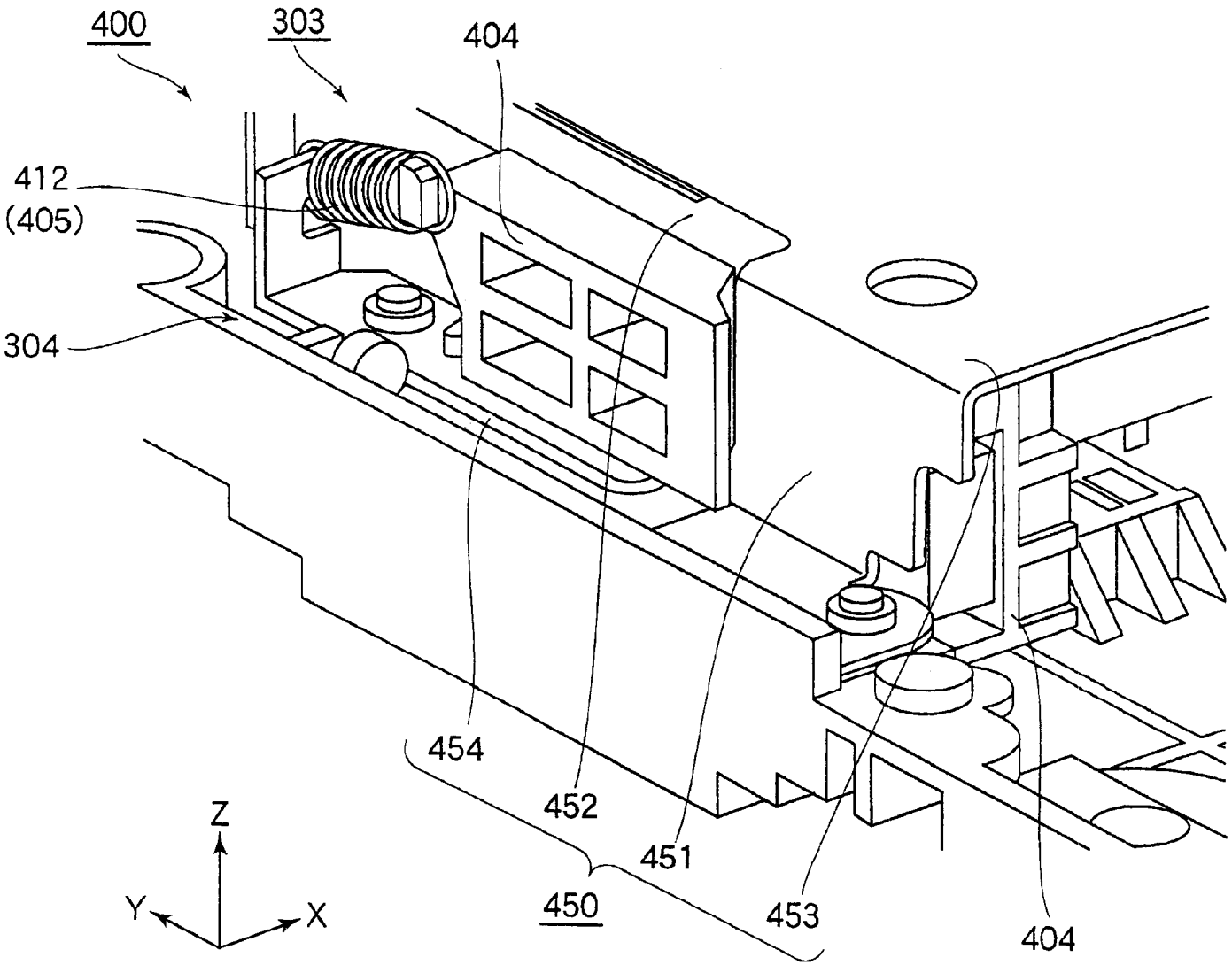
FIG. 14 is a perspective view showing a contact device according to a third modified embodiment.
Figure 15:
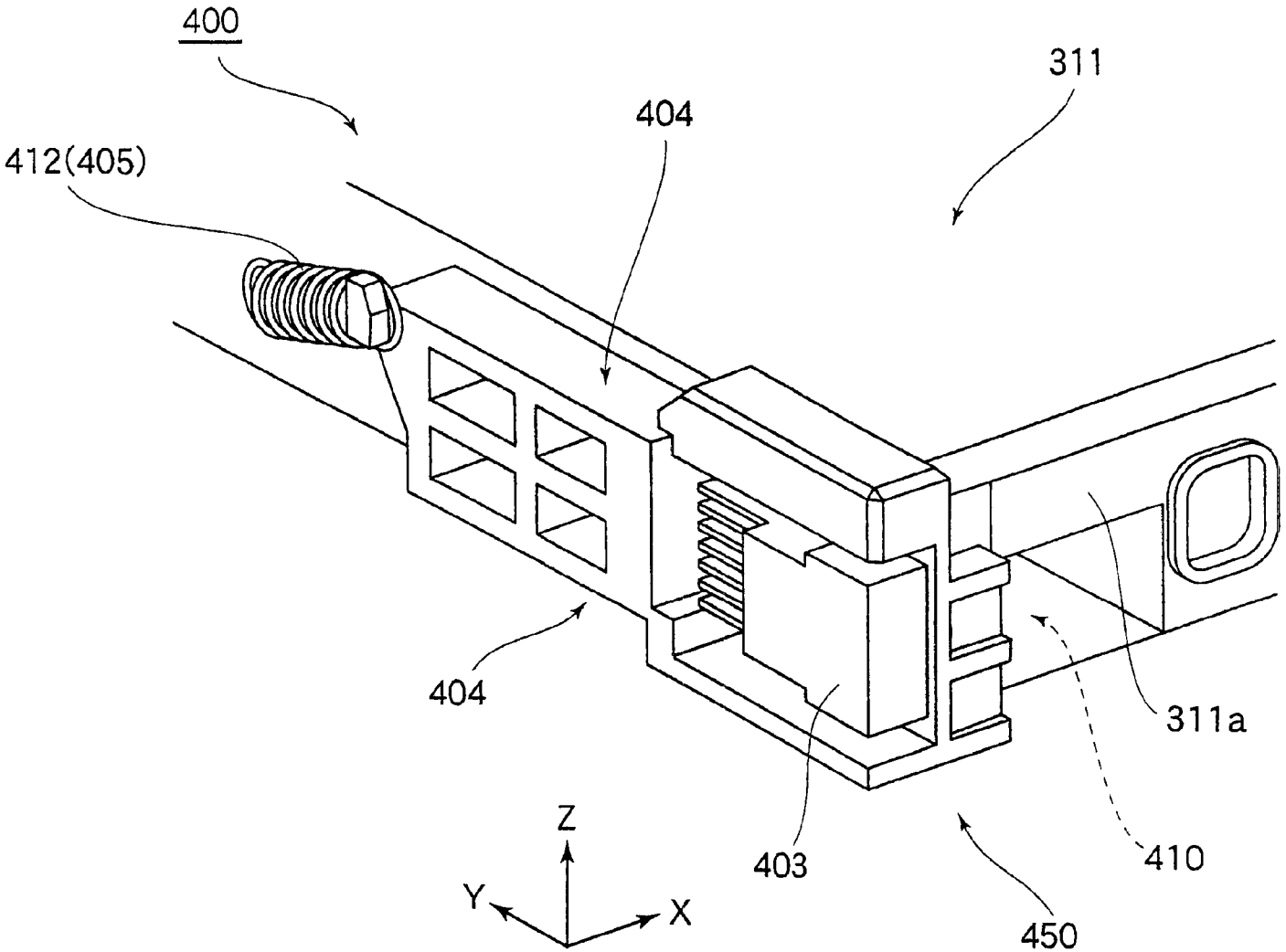
FIG. 15 is a perspective view showing a contact device where a restriction portion 450 is removed from FIG. 14.
Figure 16:
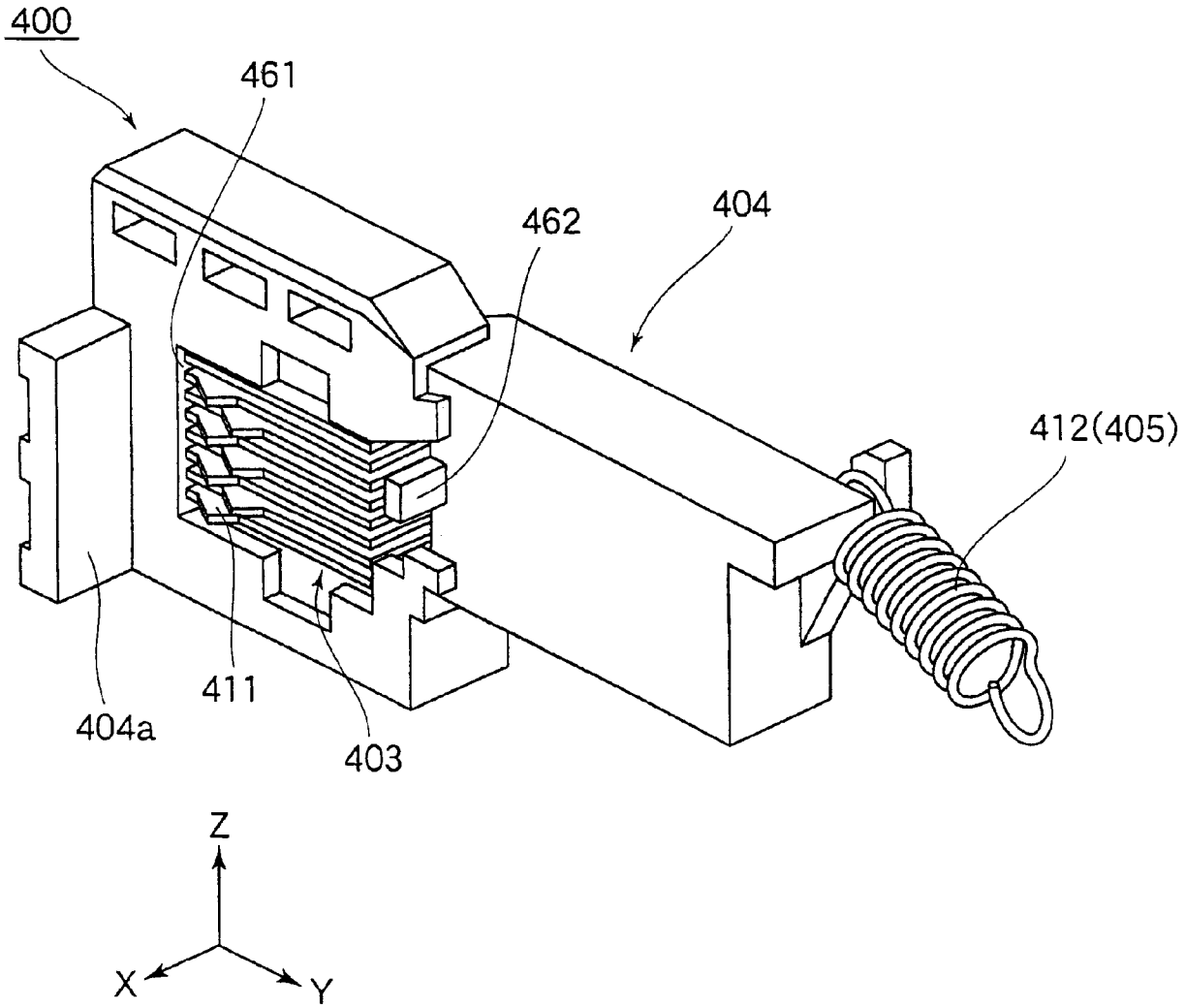
FIG. 16 is a perspective view showing a contact device according the third modified embodiment as seen from an ink cartridge.

FIG. 14 is a perspective view showing the contact device according to the third modified embodiment in a state that the mounting of the later-described ink cartridge 311 is completed. FIG. 15 is a perspective view showing a contact device where the restriction portion 450 is removed from FIG. 14. The state is the same as that of the aforementioned embodiment shown in FIG. 6. FIG. 16 is a perspective view showing the contact device according the third modified embodiment as seen from the ink cartridge.

Figure 22:
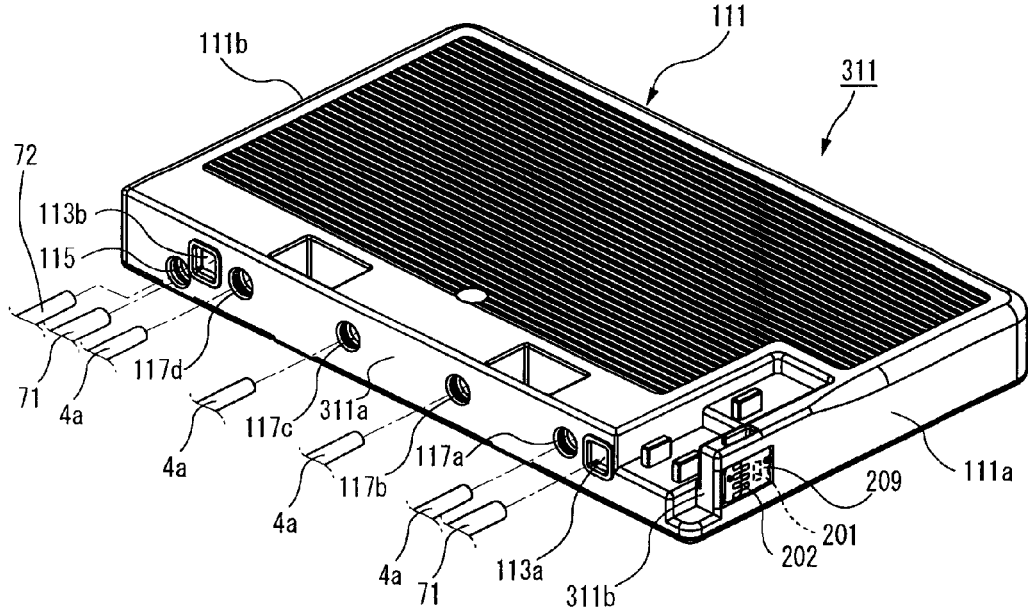
FIG. 22 is a perspective view showing the ink cartridge shown in FIG. 21 as seen from a bottom surface side of the inserting direction front end side.

Similar to FIG. 5, a side surface of the ink cartridge 311 is provided with a storage device 201 which stores information on the remaining ink amount and a substrate 209 which includes a plurality of connection terminal portions 202 connected to the storage device 201 (see FIG. 22). In addition, an inserting direction contact surface 311*b* which contacts with a portion facing the inserting direction in the cartridge mounting portion is provided to the one of two sides of the inserting direction front end side 311*a* of the ink cartridge 311.

As shown in FIG. 14, a body of a recording apparatus 303 of a contact device 400 is provided with a holder 404, and a rear end side of the ink cartridge 311 of the holder 404 in the inserting/mounting direction is fixed to the holder spring 412, that is, pressing means 405. In addition, the other end of the holder spring 412 is fixed to a substrate 304 of the body of the recording apparatus 303. Here, when the ink cartridge is mounted, the holder 404 contacts with the ink cartridge 311 and move in one body in the inserting/mounting direction. Since the contacting and movement are the same as those of the aforementioned embodiments, description thereof is omitted, and hereinafter, difference therebetween is described As shown in FIGS. 15 and 16, the holding spring 412 is disposed to be slanted with respect to the Y-axis direction. More specifically, the holding spring 412 is formed to extend in the X-axis and Z-axis directions as well as the Y-axis direction. Namely, the holding spring 412 presses the holder 404, so that the holder 404 moves in the X-axis, Y-axis, and Z-axis directions. In addition, the restriction portion 450 for restricting the movement direction of the holder 404 includes a first restriction portion 451, a second restriction portion 452, a third restriction portion 453, and a fourth restriction portion 454 in one body, as described later.

The first restriction portion 451 and the second restriction portion 452 restrict the movement of the holder 404 in the X-axis direction and the rotation of the holder 404 around the Z-axis as a supporting point.

On the other hand, the third restriction portion 453 and the fourth restriction portion 454 restrict the movement of the holder 404 in the Z-axis direction and the rotation of the holder 404 around the X-axis as a supporting point.

As shown in FIG. 16, the holder 404 is provided with a contact portion 404*a* which can contact with the inserting direction contact surface 311*b* of the ink cartridge 311 as a relative positioning unit 410 when the ink cartridge 311 is mounted. In addition, the holder 404 is provided with a claw member 462 and a connector restriction portion 461, and the connector 403 is interposed between the claw member 462 and the connector restriction portion 461. The connector 403 which is held by the holder 404 is provided with a pin-shaped terminal 411 which can contact with the connection terminal portion 402 of the ink cartridge.

Figure 17:
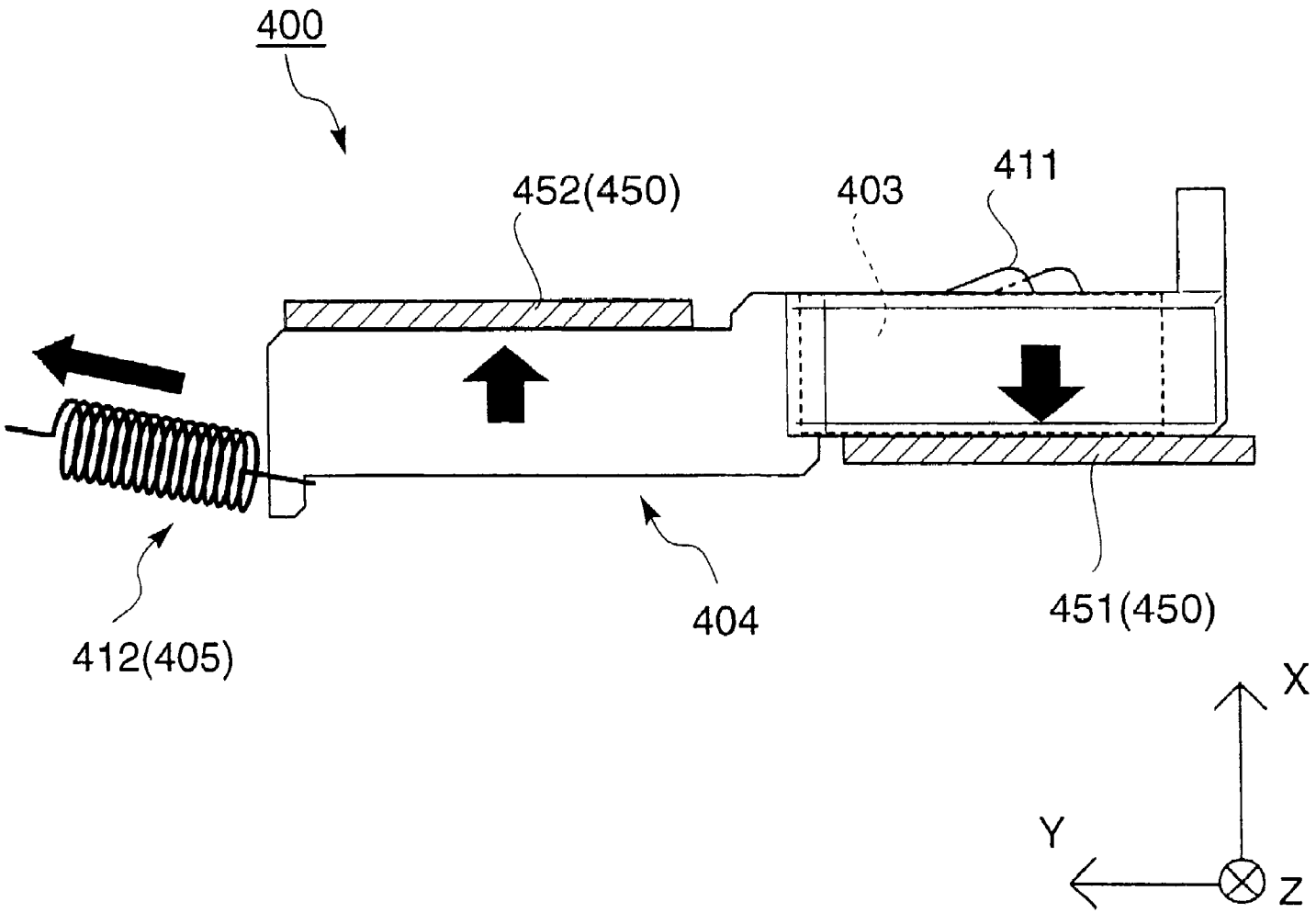
FIG. 17 is a cross sectional plan view showing the contact device according to the third modified embodiment.
Figure 18:
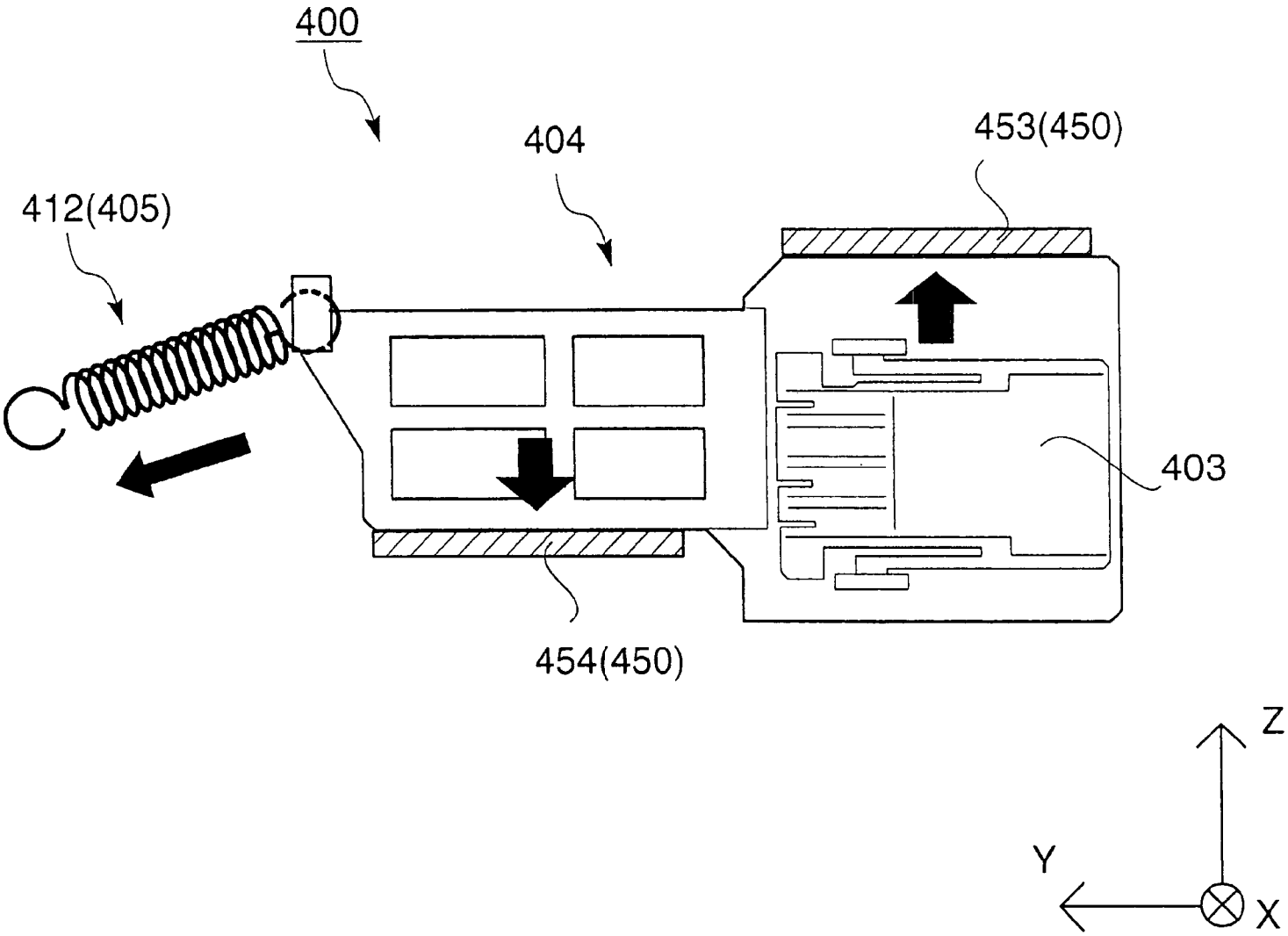
FIG. 18 is a cross sectional side view showing the contact device according to the third modified embodiment.

FIG. 17 is a cross sectional plan view showing the contact device 400, and FIG. 18 is a cross sectional side view showing the contact device 400.

As shown in FIG. 17, as described above, the holder spring 412 is disposed to be slanted with respect to the Y-axis, and the holder spring presses the holder 404 in the X-axis direction as well as Y-axis direction. In addition, due to the pressing force of the holder spring 412, a clockwise rotational force around the Z-axis direction as a supporting point is generated to the holder 404. At this time, due to the pressing force and the rotational force of the holder spring 412, the holder 404 is pressed toward the second restriction portion 452, and due to the rotational force thereof, the holder is pressed toward the first restriction portion 451. Namely, the first restriction portion 451 and the second restriction portion 452 can determine the position of the holder 404 in the X-axis direction and restrict the direction thereof with respect to the Z-axis direction as a supporting point.

Similarly, as shown in FIG. 18, the holder spring 412 is disposed to be slanted with respect to the Y-axis, and the holder spring presses the holder 404 in the Z-axis direction as well as Y-axis direction. In addition, due to the pressing force of the holder spring 412, a counterclockwise rotational force around the X-axis direction as a supporting point is generated to the holder 404. At this time, due to the pressing force and the rotational force of the holder spring 412, the holder 404 is pressed toward the fourth restriction portion 454, and due to the rotational force thereof, the holder is pressed toward the third restriction portion 453. Namely, the third restriction portion 453 and the fourth restriction portion 454 can determine the position of the holder 404 in the Z-axis direction and restrict the direction thereof with respect to the X-axis direction as a supporting point.

In addition, as shown in FIG. 17, with respect to the direction of the holder 404 with the Y-axis direction as a supporting point, the second restriction portion 452 contacts with the holder 404 in a surface manner, so that the direction of the holder 404 with the Y-axis direction as a supporting point is restricted.

By doing so, the movement of the holder 404, that is, the movement thereof in the X-axis and Z-axis directions other than the inserting/mounting direction of the ink cartridge 311 is restricted by the restriction portion 450. As a result, it is possible to determine the position of the holder 404 in the X-axis and Y-axis directions with a high accuracy. In addition, it is possible to determine the direction of the holder 404 with a high accuracy.

Figure 19:
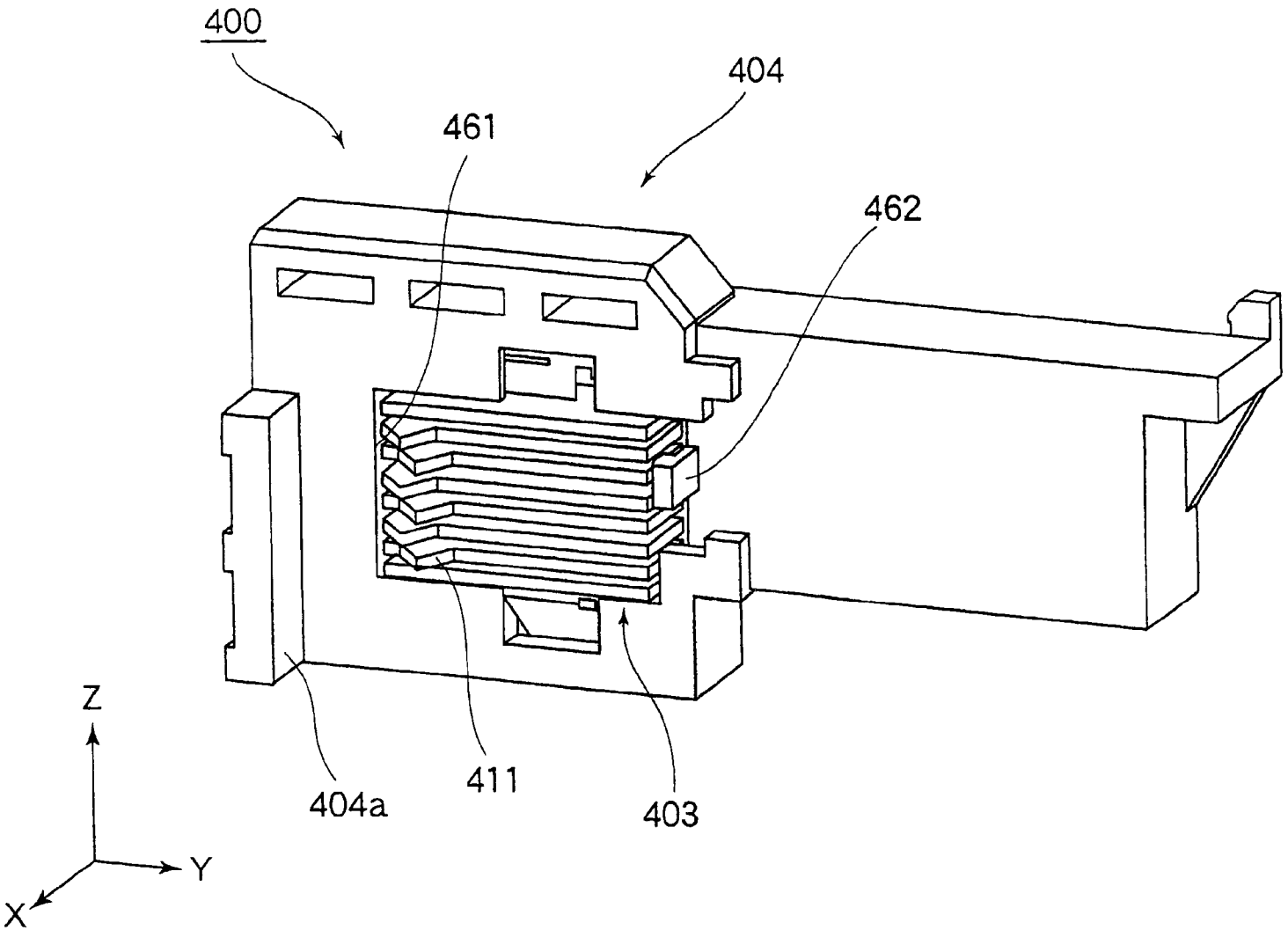
FIG. 19 is a perspective view showing a contact device according the third modified embodiment as seen from an ink cartridge.

FIG. 19 is a perspective view showing the contact device 400 as seen from an ink cartridge. In addition, FIG. 20 is a cross sectional bottom view showing the contact device 400.

Figure 20:
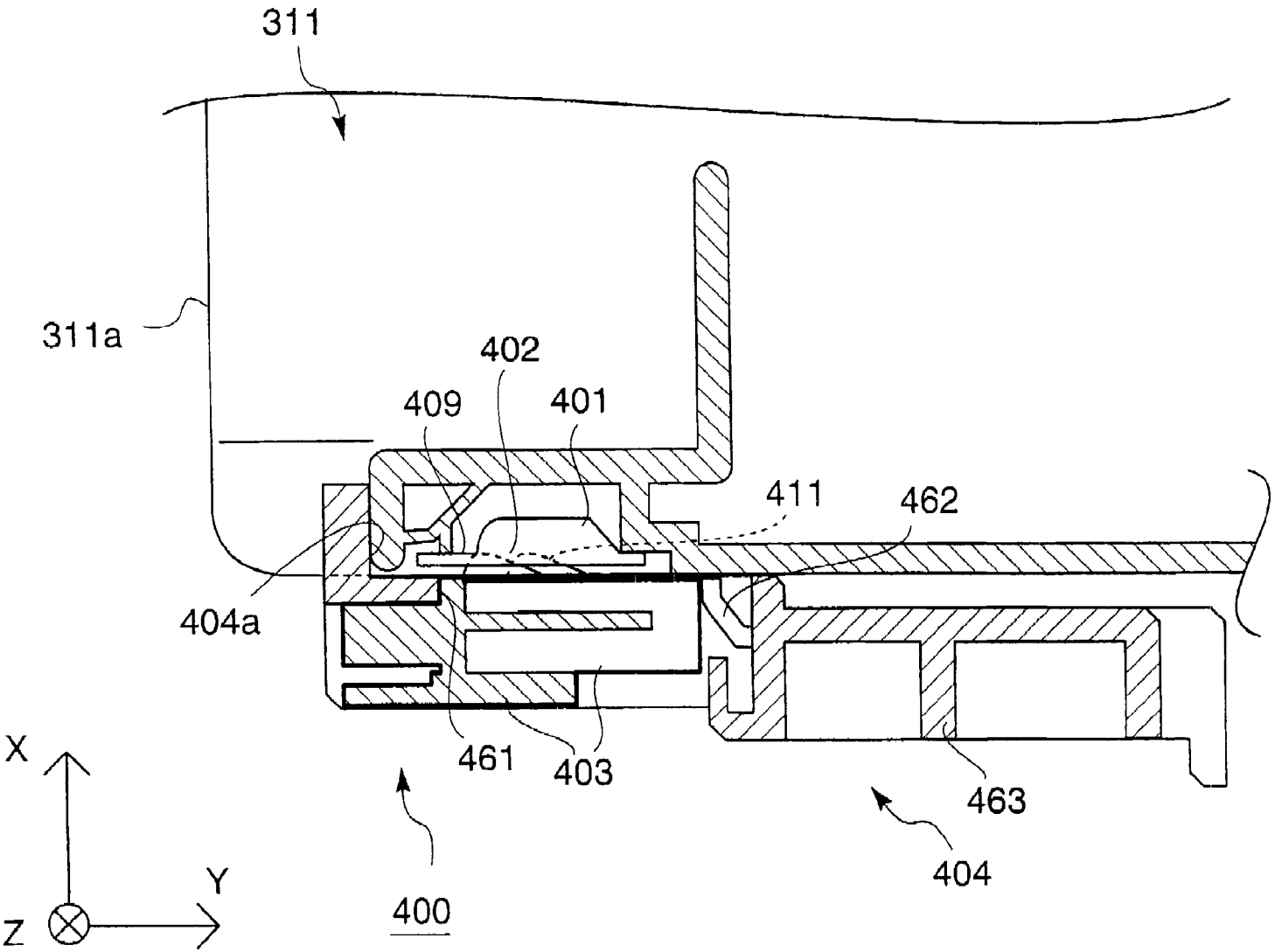
FIG. 20 is a cross sectional bottom view showing the contact device according to the third modified embodiment.

As shown in FIGS. 19 and 20, the front end side of the holder 404 in the inserting/mounting direction is provided with a connector restriction portion 461, that is, a surface for restricting the movement of the connector 403 with respect to the holder 404. On the other hand, a rear end side of the holder 404 is provided with a claw member 462 which is elastically deformed to have a pressing force toward the connector restriction portion 461. As described above, the connector 403 is interposed between the connector restriction portion 461 and the claw member 462.

When the ink cartridge 311 is mounted, due to a friction generated between the pin-shaped terminal 411 of the connector 403 and the ink cartridge 311, the connector 403 is pressed on the connector restriction portion 461 of the front end side of the holder 403. At this time, since the surface of the connector 403 is pressed on the surface of the connector restriction portion 461, any deformation of the components does not occur. Therefore, a variation in the position of the connector 403 to the holder 404 cannot occur. On the other hand, even in a case where the ink cartridge 311 is mounted, since the elastically deformable claw member 462 is provided to the rear end side of the holder 400 in the mounting direction when a frictional force is not exerted, the claw member in cooperation with the connector restriction portion 461 interposes the connector 403 and determines the position thereof without deformation and with the pressing force maintained. As a result, when the ink cartridge 311 is mounted, it is possible to further securely contact the pin-shaped terminal 411 of the connector 403 with the connection terminal portion 402 of the ink cartridge.

When the ink cartridge 311 is detached, due to a friction generated between the pin-shaped terminal 411 of the connector 403 and the ink cartridge 311, the connector 403 is pressed on the claw member 462 of the front end side of the holder 403. At this time, although the claw member 462 is slightly deformed, when the ink cartridge 311 is detached, there is no need to contact the connection terminal portion 402 with the pin-shaped terminal 411. Therefore, although there is a slight variation of the position of the connector 403 to the holder 404, any defect does not occur. Next, after the friction is removed, the claw member 462 presses the connector 403 to the connector restriction portion 461 of the holder front end side again to interpose the connector 403 in cooperation with the connector restriction portion 461.

In addition, the claw member 462 is arranged to extend from a bottom portion 463 of the holder 404 to the front end side and be directed to the ink cartridge. Therefore, the connector 403 can be easily incorporated into the holder 404 by inserting the connector 403 from a side which does not face the ink cartridge 311 of the holder 403, that is, the first restriction portion side.

In addition, if the connector 403 is allowed to directly contact with the first restriction portion 451, a tolerance of a size of the holder 404 does not influence, so that it is possible to improve a positioning accuracy in the X-axis direction.

In the contact device according to the present invention, effects thereof can be obtained irrespective of whether or not of the attaching/detaching device of the ink cartridge (liquid cartridge) is provided. Particularly, when the ink cartridge is mounted, the contact device can be effectively used for a recording apparatus having an ink cartridge attaching/detaching device where a variation of the position of the ink cartridge is relatively easy to occur. In other words, in the aforementioned embodiments, the ink cartridge is not mounted on the carriage. But not limited to the embodiments, the ink cartridge may be mounted on the carriage.

Next, the ink cartridge 311 according to the present invention is described with reference to FIGS. 21 to 26.

Figure 21:
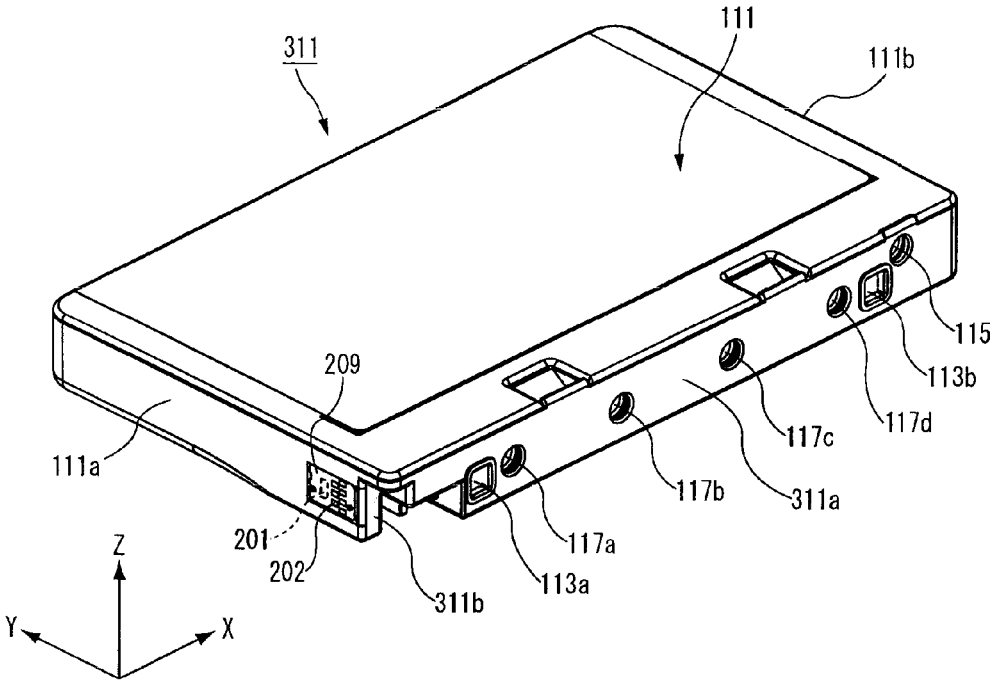
FIG. 21 is a perspective view showing an ink cartridge according to an embodiment of the present invention as seen from a top surface side of an inserting direction front end side.
Figure 23:
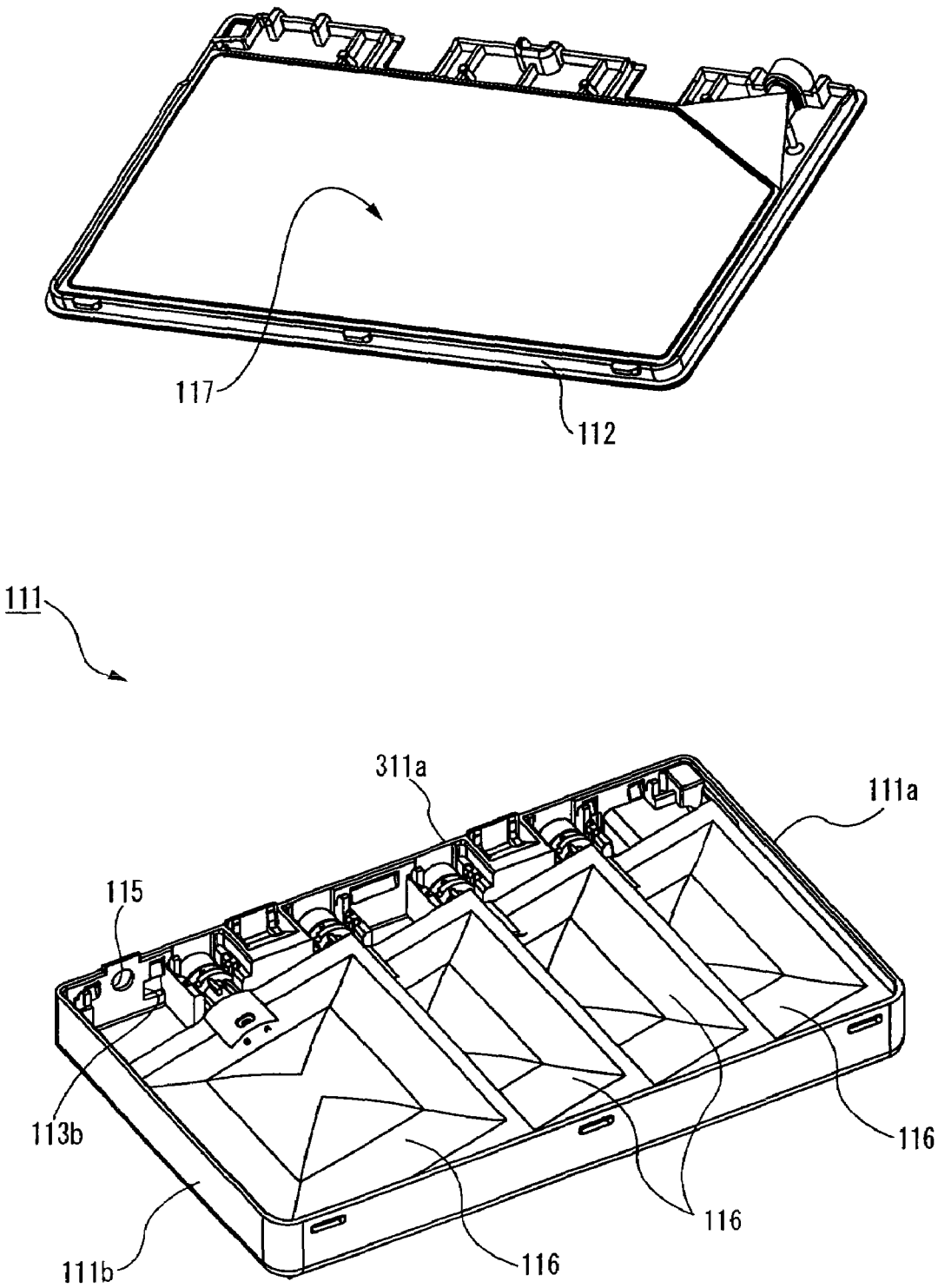
FIG. 23 is an exploded perspective view showing the ink cartridge shown in FIG. 21.
Figure 24B:
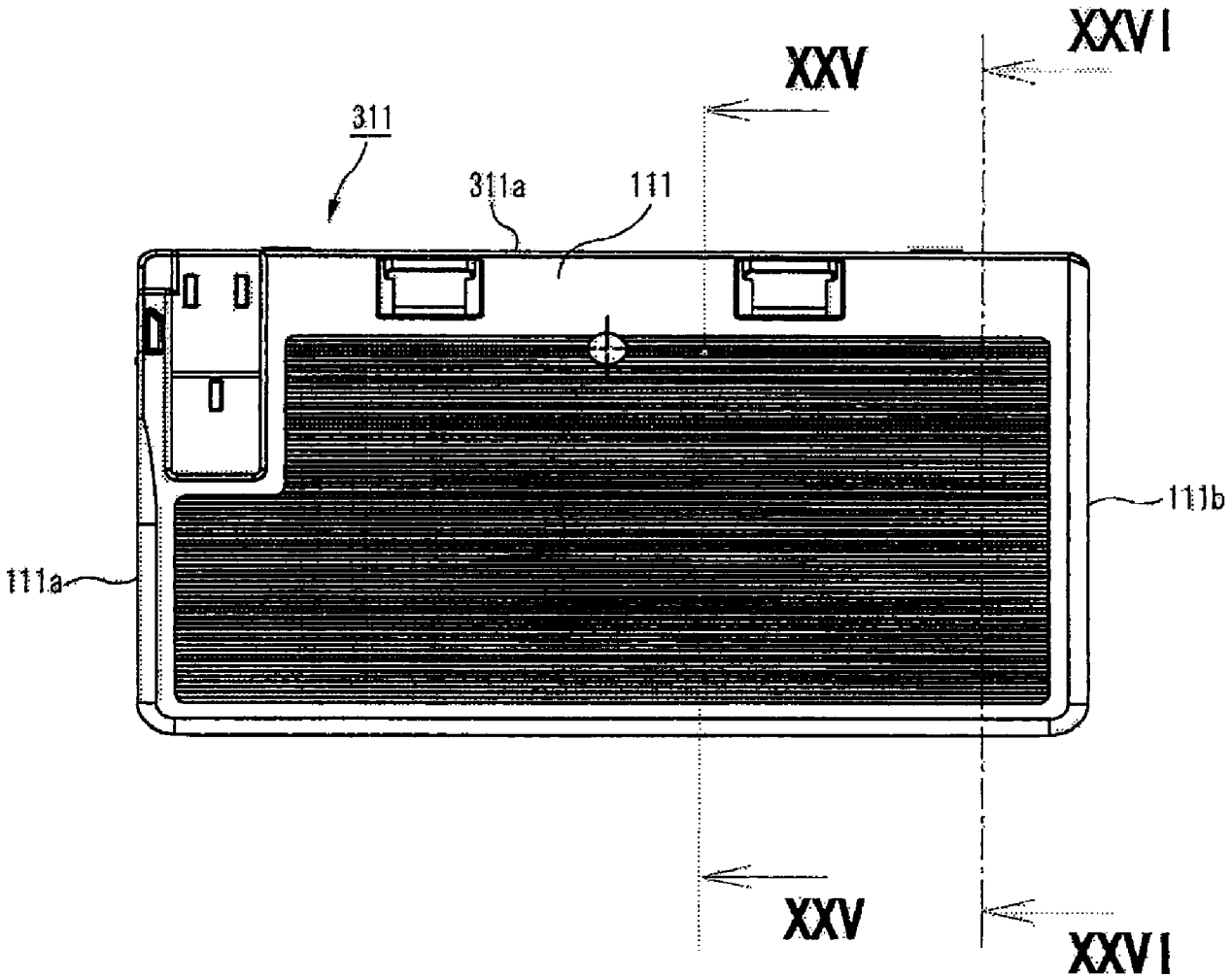
FIG. 24B is a top view showing the ink cartridge shown in FIG. 21.
Figure 24A:
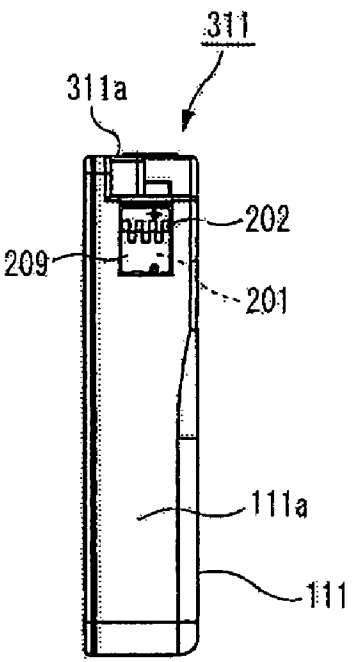
FIG. 24A is a side view showing the ink cartridge shown in FIG. 21.
Figure 25:
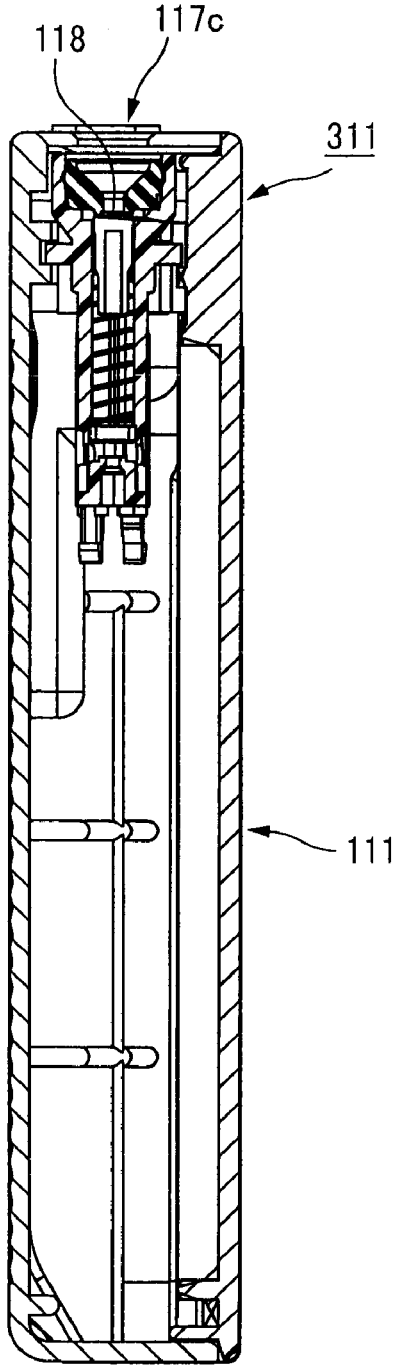
FIG. 25 is a cross sectional view showing the ink cartridge as seen from an arrow direction XXV-XXV of FIG. 24B.
Figure 26:
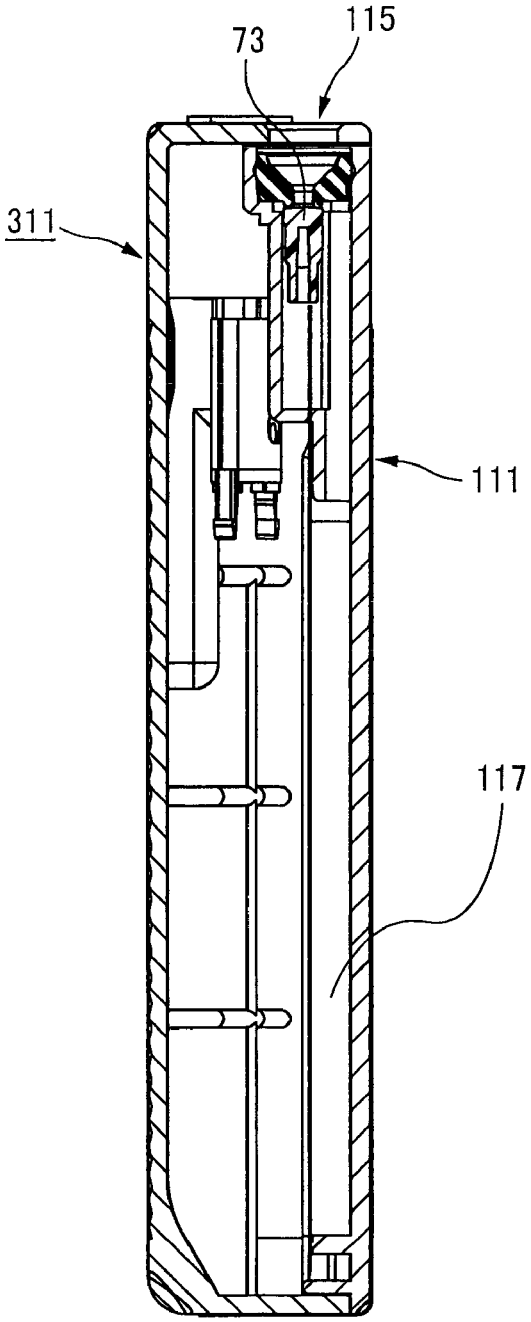
FIG. 26 is a cross sectional view showing the ink cartridge as seen from an arrow direction XXVI-XXVI of FIG. 24B.
Figure 27:
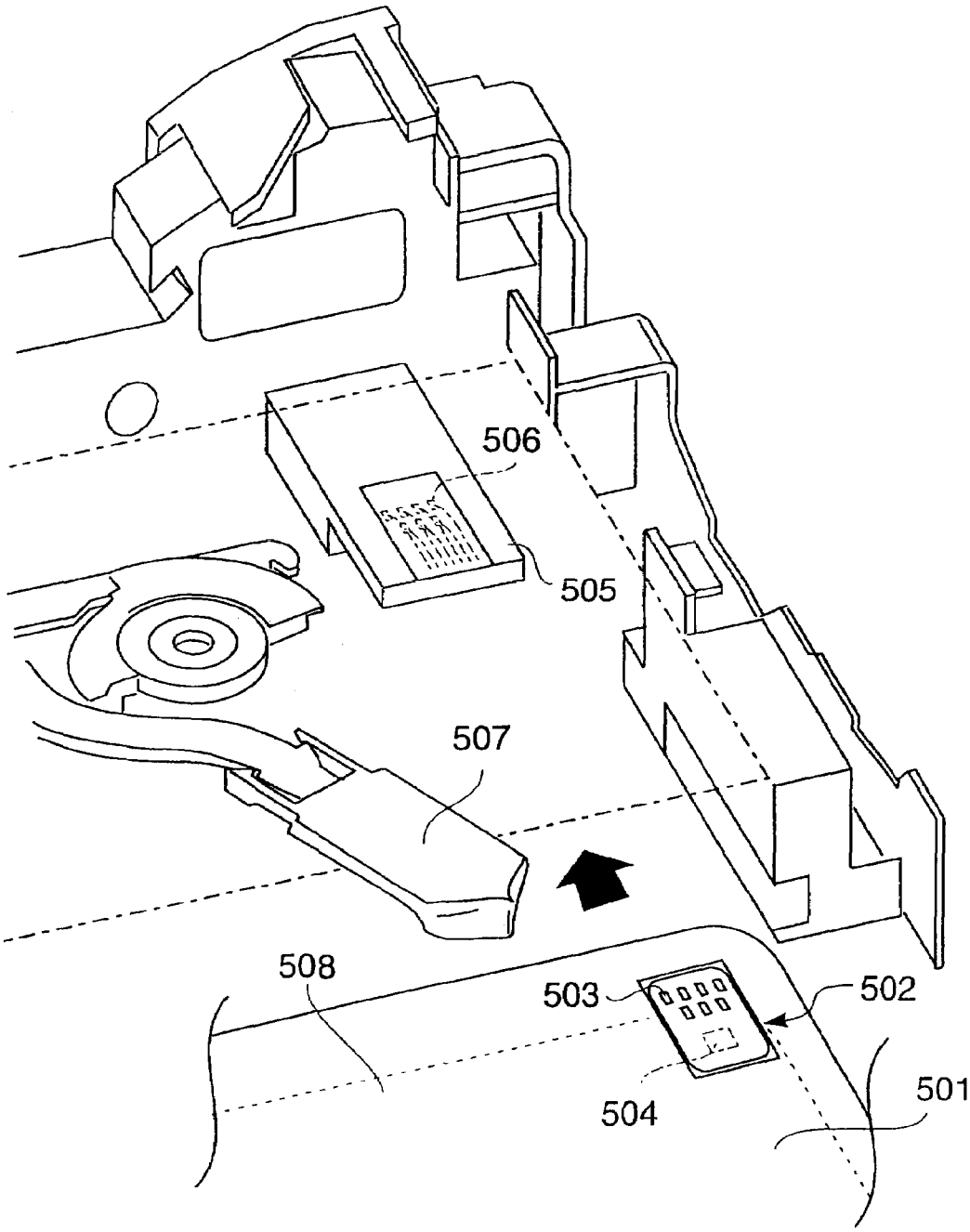
FIG. 27 is a perspective view showing a construction of a conventional ink cartridge and a cartridge mounting portion of a printer.

FIG. 21 is a perspective view showing the ink cartridge according to an embodiment of the present invention as seen from a top surface side of an inserting direction front end side. FIG. 22 is a perspective view showing the ink cartridge as seen from a bottom surface side of the inserting direction front end side. FIG. 23 is an exploded perspective view showing the ink cartridge shown in FIG. 21. FIG. 24A is a side view showing the ink cartridge shown in FIG. 21. FIG. 24B is a top view showing the ink cartridge shown in FIG. 21. FIG. 25 is a cross sectional view showing the ink cartridge as seen from an arrow direction XXV-XXV of FIG. 24B. FIG. 26 is a cross sectional view showing the ink cartridge as seen from an arrow direction XXVI-XXVI of FIG. 24B. In the embodiment, the top surface and the bottom surface of the ink cartridge are defined as a single body of the cartridge, and the attaching/detaching direction of the ink cartridge to the cartridge mounting portion is not limited by the definition.

As shown in FIGS. 21 and 22, the ink cartridge 311 according to the embodiment includes a container body 111 which is detachably mounted on the cartridge mounting portion 7 and has an outer shape of a rectangular body and a connection terminal portion 202 which is provided to a side surface of the container body 111 and can contact with an electrical connector 403 (see FIG. 15) provided to the cartridge mounting portion.

In addition, an inserting direction contact surface 311*b* which contact with a portion of the cartridge mounting portion 7 facing the inserting direction is provided to the one of both side portions of the inserting direction front end side of the container body 111, and the aforementioned connection terminal portion 202 is provided in the vicinity of the inserting direction contact surface 311*b*.

Here, the term "both side portions of the inserting direction front end side of the container body 111" is used to include a portion of the inserting direction front end side of the left and right side surfaces 111*a* and 111*b* of the container body 111 as well as both end sides of the inserting direction front end side 311*a* of the container body 111.

The connection terminal portion 202 is disposed on a surface of the substrate 209 which is provided to the side surface of the container body 111 to have a function of connecting the storage device 210 which is disposed on a rear surface or the like of the substrate 209 to store information on the remaining ink amount to an external circuit (the aforementioned connector 403 of the cartridge mounting portion 7).

In the embodiment, as shown in FIGS. 15 to 20, the connector 403 provided to the cartridge mounting portion 7 is held by the holder 404 which can move in the inserting direction of the ink cartridge 311.

In addition, the aforementioned inserting direction contact surface 311*b* contacts with the positioning contact portion 404*a* (see FIG. 16) provided to the holder 404 to move the holder 404 in the inserting direction of the ink cartridge 311.

In the embodiment, as shown in FIGS. 21 and 22, the front end surface 311*a* of the container body 111 which is located on the inserting direction front end side of the ink cartridge 311 is provided with two positioning holes 113*a* and 113*b* for determining the position of the container body 111 with respect to the cartridge mounting portion 7. In addition, the aforementioned connection terminal portion 202 is disposed on the other side surface, that is, the right side surface 111*a* perpendicular to the front end surface 311*a*.

The positioning holes 113*a* and 113*b* are holes having an opening shape of a rectangle and, as shown in FIG. 22, is engaged with a pair of positioning pins 71 provided to the cartridge mounting portion 7 facing the inserting direction of the cartridge to determine the position in a direction perpendicular to the inserting direction of the cartridge.

As shown in FIGS. 21 and 22, in the container body 11 according to the embodiment, a pair of the positioning holes 113*a* and 113*b* are provided near both side portions of the front end surface 311*a*, respectively. In addition, the aforementioned inserting direction contact surface 311*b* is disposed to a position near the one-side positioning hole 113*a*.

In addition, a waste liquid recovery opening 115 for recovering a waste liquid in the container body 111 is provided to a side portion (that is, the front end side portion of the left side surface 111*b*) opposite to the side portion (that is, the front end side portion of the right side surface 111*a*) of the inserting direction front end side near the side surface provided with the connection terminal portion 202.

As shown in FIGS. 23 and 26, in the container body 111, a waste recovery chamber 117 which is connected to the waste liquid recovery opening 115 is formed to be partitioned along an inner surface of an upper cover 112. The waste recovery chamber 117 is filled with an absorbing material for absorbing the waste ink, so that a counter flow of the waste ink recovered in the waste recovery chamber 117 can be prevented.

When the ink cartridge 311 is mounted on the cartridge mounting portion 7, the waste ink supply needle 72 (see FIG. 22) provided to the cartridge mounting portion 7 is inserted into the waste liquid recovery opening 115, so that the waste ink generated during a cleaning process of the recording head 13 is supplied to the waste recovery chamber 117 through the waste ink supply needle.

In addition, as shown in FIG. 26, the waste liquid recovery opening 115 is provided with a sealing member 73 for sealing a gap between the waste liquid recovery opening and the waste ink supply needle 72 inserted into the waste liquid recovery opening 115.

The waste liquid recovery opening 115 is set to an outer side of the two positioning holes 113*a* and 113*b* provided to the front end side 311*a* of the container body 111 and a position near the positioning hole 113*b*.

In the container body 111 according to the embodiment, as shown in FIG. 23, a plurality (four in the embodiment) of ink packs (liquid storage packs) 116 for storing an ink solution supplied to the recording head 13 of the inkjet printer 100 are received therein.

Therefore, the front end surface 311 is provided with a plurality of liquid supply openings 117*a*, 117*b*, 117*c*, and 117*d* for connecting the ink supply needle 4*a* provided to the cartridge mounting portion 7 to the ink packs 116.

As shown in FIG. 25, the liquid supply openings 117*a*, 117*b*, 117*c*, and 117*d* is provided with a valve mechanism 118 for opening and closing a channel according to the inserting of the ink supply needle 4*a* provided to the cartridge mounting portion 7.

As shown in FIG. 2, the ink supply needle 4*a* provided to the cartridge mounting portion 7 is connected to the recording head 13 through the channel member 4.

All the liquid supply openings 117*a*, 117*b*, 117*c*, and 117*d* provided to the front end side 311*a* of the container body 111 are arrayed between the two positioning holes 113*a* and 113*b*.

According to the ink cartridge 311 described above, the side portion (a portion near the front end portions of the left and right side surfaces of the container body 111) of the inserting direction front end side provided with the inserting direction contact surface 311*b* is disposed to be close to the corner portion having a high rigidity even in a case where the wall portion of the container body 111 is formed to be thin in comparison with, for example, a central portion of the front end surface 311*a* of the container body 111 or a central portion of a large-sized wall surface. Therefore, it is possible to obtain a high rigidity without bending or the like. In addition, in a case where the container body 111 is formed by performing an injection molding process on a resin, it becomes a portion where deformation is not easy to occur, so that it is possible to obtain a high molding accuracy.

Namely, since the inserting direction contact surface 311*b* can be formed to have a high rigidity with a high accuracy, it is possible to determine the position of the ink cartridge 311 with a high accuracy when the ink cartridge 311 is mounted on the cartridge mounting portion 7. In addition, since the connection terminal portion 202 is provided in the vicinity of the inserting direction contact surface 311*b* of which position is determined with a high accuracy, the positioning accuracy of the connection terminal portion 202 to the cartridge mounting portion 7 can be improved. As a result, it is possible to securely connect the connection terminal portion 202 provided to the ink cartridge 311 to the connector 403 provided to the cartridge mounting portion 7.

In addition, according to the ink cartridge 311 of the embodiment, when the ink cartridge 311 is inserted into the cartridge mounting portion 7, the connector 403 is movably held by the holder 404 and moves according to the inserting of the cartridge. Therefore, the position accuracy between the inserting direction contact surface 311*b* and the connector 403 can be maintained to be a high accuracy irrespective of whether or not there is a variation in size of the container body in the inserting direction. As a result, it is possible to improve reliability of electrical connection between the connection terminal portion 202 of the ink cartridge 311 and the connector 403 of the cartridge mounting portion 7.

In addition, according to the ink cartridge 311 of the embodiment, the connection terminal portion 202 is provided to a right side surface as another side surface perpendicular to the front end surface 311*a* provided with the positioning holes 113*a* and 113*b* for determining the position with respect to the cartridge mounting portion 7. Therefore, the spring force of the pin-shaped terminal 411 of the connector 403 which is pressed to contact with the connection terminal portion 202 becomes a force of pressing the container body 111 along the inserting direction front end surface provided with the positioning holes 113*a* and 113*b* and a pressing force for removing a gutter between the positioning holes 113*a* and 113*b* and the positioning pin 71 of the cartridge mounting portion 7 engaged with the positioning holes 113*a* and 113*b*.As a result, a variation in a contactness between the connection terminal portion 202 and the connector 403 caused from the occurrence of the gutter does not occur, so that it is possible to further stabilize a performance of electrical connection between the connection terminal portion 202 and the connector 403.

In addition, according to the ink cartridge 311 of the embodiment, the inserting direction contact surface 311*b* for determining the position with respect to the cartridge mounting portion 7 in the inserting direction is disposed to be close to the positioning hole 113*a* for determining the position in the direction perpendicular to the inserting direction. Therefore, the positioning accuracy of the inserting direction contact surface 311*b* with respect to the cartridge mounting portion 7 can be improved. As a result, it is possible to further stabilize a performance of electrical connection between the connection terminal portion 202 and the connector 403.

In addition, according to the ink cartridge 311 of the embodiment, the waste liquid recovery opening 115 for recovering the waste liquid in the container body 111 is provided to the side portion opposite to the side portion provided with the connection terminal portion 202. Therefore, a separation distance between the waste liquid recovery opening 115 and the connection terminal portion 202 is increased. As a result, although the waste solution is leaked out in the vicinity of the waste liquid recovery opening 115 at a time of replacing the cartridge or the like, it is possible to prevent a problem in that the leaked waste solution is attached on the connection terminal portion 202.

In addition, according to the ink cartridge 311 of the embodiment, the positioning hole 113*b* is interposed between the liquid supply opening 117*d* and the waste liquid recovery opening 115. Therefore, although the waste solution is leaked out in the vicinity of the waste liquid recovery opening 115 at a time of replacing the cartridge or the like, the positioning hole 113*b* can suppress the leaked waste solution from flowing along the wall surface of the container toward the liquid supply opening 117*d*. As a result, it is possible to prevent a problem in that the leaked waste solution is attached on liquid supply opening 117*d*.

In addition, according to the ink cartridge 311 of the embodiment, the waste liquid recovery opening 115 is disposed to be close to the positioning hole 113*b*, so that the positioning accuracy of the waste liquid recovery opening 115 with respect to the cartridge mounting portion 7 can be improved. Therefore, an accuracy of connection between a waste supply pipe provided to the cartridge mounting portion 7 and the waste liquid recovery opening 115 can be improved. As a result, it is possible to prevent a problem of the leakage of the waste solution caused from deterioration of the accuracy of connection.

In addition, according to the ink cartridge 311 of the embodiment, a plurality of the ink packs 116 is received in the single container body 11. Therefore, in comparison with, for example, a case where ink cartridges dedicated to colors are individually prepared, simplification of the positioning mechanism provided to the cartridge mounting portion 7 or the reduction of the number of parts thereof can be implemented. As a result, it is possible to obtain a compact product and reduce production cost (see FIG. 23).

In addition, according to the ink cartridge 311 of the embodiment, a plurality of the liquid supply openings 117*a*, 117*b*, 117*c*, and 117*d* provided to the front end surface 311*a* are disposed between the two positioning holes 113*a* and 113*b*.Therefore, when the ink cartridge 311 is mounted on the cartridge mounting portion 7, a variation of the positions of the liquid supply openings 117*a*, 117*b*, 117*c*, and 117*d* can be suppressed below a variation width between the two positioning holes 113*a* and 113*b*.As a result, it is possible to improve a performance of connection between the liquid supply needles or the like provided to the cartridge mounting portion 7 and the liquid supply openings 117*a*, 117*b*, 117*c*, and 117*d*.

Detailed structures of components of the liquid cartridge according to the present invention is not limited to the aforementioned embodiments, but it can be suitably modified without departing from a spirit of the present invention. The modifications are also included in the scope of the present invention. In addition, a liquid consuming apparatus on which the liquid cartridge according to the present invention is mounted is not limited to the inkjet printer disclosed in the aforementioned embodiments.

In addition, the present invention is not limited to the embodiments, but it may be modified in various manners within the scope of the present invention disclosed in the attached claims. These are also included in the scope of the present invention.

What is claimed is:

1. A liquid cartridge, adapted to be detachably mounted to a cartridge mounting portion of a liquid consuming apparatus, the liquid cartridge comprising:

a substrate including at least one connection terminal portion adapted to be electrically connected to a connector provided in the cartridge mounting portion; and a container body, having;

a first wall, formed with a liquid supplying port adapted to supply liquid in the container body to the liquid consuming apparatus, a second wall, extending perpendicularly to the first wall, and a third wall, extending parallel to the first wall at a position recessed from the first wall in a first direction, and intersecting with the second wall, wherein the third wall is located at a position between the second wall and the liquid supplying port, and adapted to come in contact with the cartridge mounting portion; and wherein the substrate is mounted on the second wall.

2. The liquid cartridge according to claim 1, wherein the third wall is adapted to come in contact with a holder holding the connector and being movable with respect to the liquid consuming apparatus.

3. The liquid cartridge according to claim 1, wherein the first wall is provided with a positioning hole configured to place the container body in a predetermined position with respect to the cartridge mounting portion.

4. The liquid cartridge according to claim 3, wherein the third wall is located at a position between the positioning hole and the second wall.

5. The liquid cartridge according to claim 1, further comprising:

a fourth wall extending perpendicularly to the first wall at an opposite side of the second wall, wherein the first wall is formed with a waste liquid recovery opening which is located at a position closer to the fourth wall, and adapted to recover waste liquid from the liquid consuming apparatus into the container body.

6. A liquid consuming apparatus adapted to accommodate the liquid cartridge according to claim 1, the liquid consuming apparatus comprising:

a cartridge mounting portion, into which the liquid cartridge is inserted in a second direction opposite to the first direction;

a connector, adapted to be electrically connected to the connection terminal portion of the liquid cartridge;

a holder, holding the connector; and a relative positioning unit, adapted to contact the third wall of the liquid cartridge and configured to cause the holder to move in the second direction in accordance with the insertion of the liquid cartridge into the cartridge mounting portion to determine a relative position between the liquid cartridge and the holder.

7. The liquid consuming apparatus according to claims 6, wherein the connector has a pin-shaped terminal adapted to come in contact with the connection terminal portion, and wherein the pin-shaped terminal are formed to be a pin spring pressing the connection terminal portion when the pin-shaped terminal comes in contact with the connection terminal portion.

8. The liquid consuming apparatus according to claim 7, wherein the connector is disposed on a surface of the cartridge mounting portion which is parallel to the second direction.

9. The liquid consuming apparatus according to claim 6, wherein the relative positioning unit comprises at least one of a protrusion and a recess adapted to engage with the third wall of the liquid cartridge.

10. The liquid consuming apparatus according to claim 9, wherein the relative positioning unit comprises:

a biasing member, biasing the holder in the first direction.

11. The liquid consuming apparatus according to claim 10, further comprising a restriction portion, restricting a movement of the holder in a third direction perpendicular to the second direction, wherein the biasing member biases the holder toward the restriction portion.

12. The liquid consuming apparatus according to claim 11, wherein the restriction portion directly contacts the connector to restrict a position of the connector in a direction that the connector and the connection terminal portion come in contact with each other.

13. The liquid consuming apparatus according to claim 10, wherein the connector is provided on a surface of the cartridge mounting portion which is parallel to the second direction, wherein the holder comprises:

a connector restriction portion, provided to a front side of the holder in the second direction; and an elastic claw member, provided to a rear side of the holder in the second direction, and wherein the connector is interposed between the connector restriction portion and the claw member while being pressed by the claw member against the connector restriction portion.

14. The liquid consuming apparatus according to claim 9, wherein the protrusion and the recess are cone-shaped.

15. The liquid consuming apparatus according to claim 9, wherein the protrusion and the recess are pyramid-shaped.

16. The liquid consuming apparatus according to claim 9, wherein the protrusion extends in the second direction.

17. The liquid consuming apparatus according to claim 9 wherein the protrusion and the recess extend in a third direction perpendicular to the second direction.

18. The liquid cartridge according to claim 1, wherein the third wall is formed with either a projection or a recess.

19. The liquid cartridge according to claim 1, wherein the at least one connection terminal portion includes a plurality of connection terminal portions which are arrayed along a line that the second wall intersects with the third wall.

* * * * *